US009230789B2

(12) United States Patent
Laue et al.

(10) Patent No.: US 9,230,789 B2
(45) Date of Patent: Jan. 5, 2016

(54) PRINTED CIRCUIT BOARD MULTIPOLE FOR ION FOCUSING

(75) Inventors: Alexander Laue, Essen (DE); Albrecht Glasmachers, Wetter (DE); Christian Hendrich, Aalen (DE); Dirk Preikszas, Oberkochen (DE); Michel Aliman, Oberkochen (DE); Hubert Mantz, Neu-Ulm (DE); Ulrike Zeile, Heidenheim (DE); Holger Dömer, Bopfingen (DE)

(73) Assignee: Carl Zeiss Microscopy GmbH, Jena (DE)

( * ) Notice: Subject to any disclaimer, the term of this patent is extended or adjusted under 35 U.S.C. 154(b) by 432 days.

(21) Appl. No.: 12/931,272

(22) Filed: Jan. 27, 2011

(65) Prior Publication Data

US 2011/0220788 A1 Sep. 15, 2011

(30) Foreign Application Priority Data

Jan. 28, 2010 (DE) ..... 10 2010 001 349

(51) Int. Cl.
*H01J 49/42* (2006.01)
*H01J 49/06* (2006.01)
*H01J 49/14* (2006.01)

(52) U.S. Cl.
CPC ..... *H01J 49/065* (2013.01); *H01J 49/067* (2013.01); *H01J 49/068* (2013.01); *H01J 49/14* (2013.01); *H01J 49/4225* (2013.01); *H01J 49/4235* (2013.01)

(58) Field of Classification Search
CPC . H01J 49/063; H01J 49/4235; H01J 2237/05; H01J 49/14; H01J 49/4225
USPC ..... 250/281, 282, 290, 292, 291
See application file for complete search history.

(56) References Cited

U.S. PATENT DOCUMENTS

| | | | | |
|---|---|---|---|---|
| 5,008,537 | A | 4/1991 | Toita et al. | |
| 5,164,594 | A | 11/1992 | Thompson et al. | |
| 5,376,791 | A | 12/1994 | Swanson et al. | |
| 5,576,540 | A | 11/1996 | Jolliffe | |
| 5,665,967 | A | 9/1997 | Coxon et al. | |
| 6,107,628 | A | 8/2000 | Smith et al. | |
| 6,462,338 | B1 | 10/2002 | Inatsugu et al. | |
| 6,730,904 | B1 * | 5/2004 | Wells | 250/292 |

(Continued)

FOREIGN PATENT DOCUMENTS

| | | | |
|---|---|---|---|
| DE | 19941670 | A1 | 3/2000 |
| DE | 10 200 6016 259 | A1 | 10/2007 |

(Continued)

*Primary Examiner* — Brooke Purinton
(74) *Attorney, Agent, or Firm* — Muirhead and Saturnell, LLC

(57) ABSTRACT

An apparatus for focusing and for storage of ions and an apparatus for separation of a first pressure area from a second pressure area are disclosed, in particular for an analysis apparatus for ions. A particle beam device may have at least one of the abovementioned apparatuses. A container for holding ions and at least one multipole unit are provided. The multipole unit has a through-opening with a longitudinal axis as well as a multiplicity of electrodes. A first set of the electrodes is at a first radial distance from the longitudinal axis. A second set of the electrodes is in each case at a second radial distance from the longitudinal axis. The first radial distance is less than the second radial distance. Alternatively or additionally, the apparatus may have an elongated opening with a radial extent. The opening has a longitudinal extent which is greater than the radial extent.

17 Claims, 20 Drawing Sheets

(56) References Cited

U.S. PATENT DOCUMENTS

| | | | | |
|---|---|---|---|---|
| 6,987,264 | B1 | 1/2006 | Whitehouse et al. | |
| 7,473,892 | B2 | 1/2009 | Sano et al. | |
| 7,595,486 | B2 | 9/2009 | Franzen | |
| 2001/0054688 | A1 | 12/2001 | Waki | |
| 2003/0189171 | A1 | 10/2003 | Londry et al. | |
| 2003/0222214 | A1 | 12/2003 | Baba et al. | |
| 2004/0149903 | A1 | 8/2004 | Wang | |
| 2004/0195503 | A1 | 10/2004 | Kim et al. | |
| 2004/0251411 | A1 | 12/2004 | Bateman et al. | |
| 2007/0164213 | A1 | 7/2007 | Javahery et al. | |
| 2007/0284524 | A1* | 12/2007 | Franzen | 250/292 |
| 2008/0067342 | A1* | 3/2008 | Ding | 250/282 |
| 2008/0251712 | A1 | 10/2008 | Sanders et al. | |
| 2009/0014644 | A1 | 1/2009 | Yang et al. | |
| 2009/0294641 | A1 | 12/2009 | Konicek et al. | |
| 2009/0309025 | A1 | 12/2009 | Preikszas | |
| 2010/0116979 | A1 | 5/2010 | Nishiguchi et al. | |
| 2011/0012017 | A1 | 1/2011 | Nishiguchi | |
| 2011/0186732 | A1* | 8/2011 | Yasuno | 250/288 |

FOREIGN PATENT DOCUMENTS

| | | | |
|---|---|---|---|
| DE | 102006059162 | A1 | 6/2008 |
| EP | 1 185 857 | B1 | 3/2002 |
| EP | 1465234 | A2 | 10/2004 |
| EP | 2 637 195 | A2 | 9/2013 |
| GB | 2 250 858 | A | 6/1992 |
| JP | H04233149 | S | 8/1992 |
| JP | H1125904 | A | 1/1999 |
| JP | H1164290 | A | 3/1999 |
| JP | 2005-522845 | A | 7/2005 |
| JP | 2009502017 | A | 1/2009 |
| JP | 2009-523300 | A | 6/2009 |
| WO | WO 01/04611 | A2 | 1/2001 |
| WO | WO2005/074004 | A2 | 8/2005 |
| WO | WO2005/119737 | A1 | 12/2005 |
| WO | WO 2007/010272 | | 1/2007 |
| WO | WO 2008/129751 | A1 | 10/2008 |
| WO | WO 2009/110025 | A1 | 9/2009 |

* cited by examiner

PRINTED CIRCUIT BOARD MULTIPOLE FOR ION FOCUSING

TECHNICAL FIELD

This application relates to an apparatus for focusing and for storage of ions, and to an apparatus for separation of a first pressure area from a second pressure area, in particular for an analysis apparatus for ions. This application also relates to a particle beam device having at least one of the abovementioned apparatuses.

BACKGROUND OF THE INVENTION

Particle beam devices have already been in use for a very long time, in order to obtain knowledge about the characteristics and behavior of samples in specific conditions. One of these particle beam devices is an electron beam device, in particular a scanning electron microscope (also referred to in the following text as an SEM).

In the case of an SEM, an electron beam (also referred to in the following text as the primary electron beam) is generated by a beam generator, and is focused by a beam guidance system, in particular an objective lens, onto a sample to be examined. The primary electron beam is passed over a surface of the sample to be examined, in the form of a raster, by a deflection device. The electrons in the primary electron beam in this case interact with the material of the sample to be examined. The interaction results in particular in interaction particles. In particular, electrons are emitted from the surface of the sample to be examined (so-called secondary electrons), and electrons are scattered back from the primary electron beam (so-called back-scattered electrons). The secondary electrons and back-scattered electrons are detected, and are used for image production. This therefore results in an image of the surface of the sample to be examined.

It is also known from the prior art for combination devices to be used to examine samples, in which both electrons and ions can be passed to a sample to be examined. By way of example, it is known for an SEM to additionally be equipped with an ion beam column. An ion beam generator which is arranged in the ion beam column is used to produce ions, which are used for preparation of a sample, (for example removal of a surface of the sample or application of material to the sample), or else for imaging. In this case, the SEM is used in particular to observe the preparation, or else for further examination of the prepared or unprepared sample.

In addition to the already mentioned image production, it is also possible to analyze the energy and/or the mass of interaction particles in more detail. For example, a method is known from mass spectrometry in which secondary ions are examined in more detail. The method is known by the abbreviation SIMS (secondary ion mass spectrometry). In this method, the surface of a sample to be examined is irradiated with a focused primary ion beam. The interaction particles produced in the process, and which are in the form of secondary ions emitted from the surface of the sample, are detected in an analysis unit, and are examined by mass spectrometry. In the process, the secondary ions are selected and identified on the basis of their ion mass and their ion charge, thus allowing conclusions to be drawn about the composition of the sample.

The sample to be examined is irradiated with the focused primary ion beam in known particle beam devices in vacuum conditions ($10^{-3}$ mbar ($10^{-1}$ Pa) to $10^{-7}$ mbar ($10^{-5}$ Pa)), generally using a hard vacuum of $10^{-6}$ mbar ($10^{-4}$ Pa). The secondary ions are also examined in a hard vacuum in the analysis unit. Since the secondary ions have a broad kinetic-energy distribution, it is, however, disadvantageous for the secondary ions to be injected directly into the analysis unit. An intermediate unit is required, which transmits the secondary ions to the analysis unit and which reduces the width of the kinetic-energy distribution before the secondary ions are injected into the analysis unit.

An apparatus for transmission of energy of a secondary ion to gas particles is known from the prior art. This apparatus has a container with an internal area in which a damping gas is located. The container is provided with a longitudinal axis, along which a first electrode, a second electrode, a third electrode and a fourth electrode extend. The first electrode, the second electrode, the third electrode and the fourth electrode are each formed from a metal bar. They form a quadrupole unit, which produces a quadrupole alternating field in the container.

The secondary ions generated by an ion beam are introduced into the container and transmit a portion of their kinetic energy to the gas particles by impacts. In order to achieve a sufficiently high impact rate for energy reduction, there is a soft vacuum in the region of $5\times10^{-3}$ mbar ($5\times10^{-1}$ Pa) in the container. The mean free path length of the secondary ions in the soft vacuum is in the millimeter range. The higher the partial pressure of the gas is in the container, the greater is the impact rate, and accordingly also the capability to transmit energy from the secondary ions to the gas particles. After passing through the container, the secondary ions should have only thermal energy.

The kinetic energy of the secondary ions can be subdivided on the one hand into a radial component and on the other hand into an axial component. The radial component causes the secondary ions to diverge from one another radially with respect to the longitudinal axis of the container. This divergence is reduced in the prior art by the abovementioned quadrupole unit. The quadrupole unit causes the secondary ions to be stored radially in an alternating field along the longitudinal axis of the container. The quadrupole alternating field is therefore a storage field. In principle, the quadrupole unit acts like a Paul trap, in which restoring forces act on the secondary ions.

It is likewise known for the secondary ions not to be stored statically within the container which is provided with the quadrupole unit, but to oscillate harmonically, and this is referred to in the following text as macro-oscillation. In order to store the secondary ions securely in the quadrupole unit, a suitable storage force ($F_{Store}$) should be provided by the quadrupole alternating field, which is proportional to the ratio of the amplitude of the quadrupole alternating field ($U_{Quad}$) to a frequency of the quadrupole alternating field ($f_{Quad}$). Therefore:

$$F_{Store} \sim \frac{U_{Quad}}{f_{Quad}} \quad [1]$$

It is also known for the macro-oscillation to have a further oscillation in the form of a micro-oscillation superimposed on it, at the frequency of the quadrupole alternating field. The micro-oscillation has an amplitude ($Z_{Micro}$) which is proportional to the ratio, of the amplitude of the quadrupole alternating field ($U_{Quad}$) to the square of the frequency of the quadrupole alternating field ($f_{Quad}$).

$$Z_{Micro} \sim \frac{U_{Quad}}{(f_{Quad})^2} \quad [2]$$

In order to avoid secondary ions being lost by the secondary ions striking one of the abovementioned electrodes of the quadrupole unit, an overall oscillation amplitude, which is the sum of the amplitude of the macro-oscillation and the amplitude of the micro-oscillation, should remain less than the radius of the internal area of the container into which the secondary ions have been introduced.

The amplitude of the macro-oscillation can be reduced by transmitting a sufficiently large amount of energy from the secondary ions to the gas particles. In contrast, the amplitude of the micro-oscillation can be reduced by increasing the frequency of the quadrupole alternating field. However, this reduces the restoring forces acting on the secondary ions in the container, as a result of which a greater quadrupole alternating field amplitude is required in order to store the secondary ions securely in the container.

The impacts of the secondary ions with the gas particles reduce the radial component of the kinetic energy, as a result of which the amplitude of the macro-oscillation is reduced, and the secondary ions are focused on the longitudinal axis of the container.

The axial component of the kinetic energy ensures that the secondary ions pass through the container along the longitudinal axis of the container in the direction of the analysis unit. The abovementioned impacts also reduce the axial component of the kinetic energy, however, as a result of which the energy of some secondary ions will no longer be sufficient to pass through the container completely as far as the analysis unit. In the prior art, a potential gradient is therefore provided on the container, wherein a potential associated with that point is provided at each point on the longitudinal axis. The secondary ions are moved axially in the direction of the analysis unit by the potential gradient. The potential gradient is configured such that the potential decreases continuously in the direction of the analysis unit, and has a potential well in the area of one end of the container, which is directed at the analysis unit. The secondary ions pass through the container and in the process transmit their energy to the gas particles, until they rest in the potential well.

The known quadrupole unit is subdivided into segments in order to produce the potential gradient. Expressed in other words, the first electrode, the second electrode, the third electrode and the fourth electrode are each subdivided into segments. Each segment has a segment length which is sufficiently short that the field punch-through of the potential is also still sufficiently effective in the center of the individual segments. It has been found that the abovementioned occurs when the segment length corresponds substantially to the core radius of the container. The expression core radius may refer to the radius of the internal area of the container within which the secondary ions can move without striking the abovementioned electrodes.

The abovementioned container has a first end and a second end. An inlet is arranged at the first end, through-which the secondary ions enter the internal area of the container from the area in which the secondary ions are generated, and which area is kept in hard-vacuum conditions. A pressure stage is arranged at the inlet. This means an apparatus which separates a first pressure area (in this case a hard vacuum, for example in a sample chamber) from a second pressure area (in this case a soft vacuum in the internal area of the container), such that the vacuum in the first pressure area does not substantially deteriorate. An outlet is provided at the second end of the container, through which the secondary ions leave the container in the direction of the analysis unit. A further pressure stage is arranged at the outlet, which separates the second pressure area (in this case the soft vacuum in the internal area of the container) from a third pressure area (in this case the hard vacuum in the analysis unit), such that the vacuum in the third pressure area does not deteriorate substantially.

With regard to the abovementioned prior art, reference is made, for example, to DE 10 2006 059 162 A1, U.S. Pat. No. 7,473,892 B2, EP 1 185 857 B1, U.S. Pat. No. 5,008,537, U.S. Pat. No. 5,376,791 and WO 01/04611, which are all incorporated herein by reference. Furthermore, reference is made to US 2009/0294641 and U.S. Pat. No. 5,576,540, which are also incorporated herein by reference.

Analyses have shown that, the configuration of the further pressure stage arranged at the outlet is not trivial. A number of preconditions must be observed. In order to have a good effect as a pressure stage, the terminating plate should have a through-opening which is as small as possible and as long as possible (generally formed by a small core hole), which connects the container to the analysis unit and through which the secondary ions can pass in the direction of the analysis unit. By way of example, if the terminating plate is formed from a conductive material, then the terminating plate acts as an electrostatic lens. It is probable that the secondary ions will be reflected on the terminating plate, attracted to it or neutralized by the terminating plate such that the secondary ions do not pass through the small through-opening to the analysis unit. The radial extent of the through-opening could admittedly be enlarged in order in this way to transfer more secondary ions from the container to the analysis unit. However, this would result in the characteristics of the terminating plate as a pressure stage becoming worse, because the larger the radial extent of the small through-opening is, the greater the extent to which the hard vacuum in the analysis unit deteriorates as a result of the ingress of gas particles from the container into the analysis unit.

It is also unsuitable for the terminating plate to be formed from a non-conductive material, because the terminating plate could become charged when secondary ions strike it and would accordingly produce disturbance fields which would disturb the quadruple alternating field in the container, or would deflect secondary ions. In this case, the effects achieved by the quadruple alternating field would be partially cancelled out again. This is undoubtedly undesirable.

Consideration has also been given to providing the internal area of the container with an axially conically converging structure, with the smallest diameter of this conically converging structure being arranged in the area of the second end of the container. This would reduce the core radius in the container to a very small extent. However, this solution is also disadvantageous, because the conically converging structure is such that the axial component of the kinetic energy of the secondary ions could once again be converted into a radial component of the kinetic energy of the secondary ions, as a result of which the secondary ions would once again carry out macro-oscillations with a greater amplitude. The amplitude of the macro-oscillation and the amplitude of the micro-oscillation can be designed such that the secondary ions are not able to pass through a through-opening in a terminating plate in the form of a pressure stage. Furthermore, analyses have shown that the mechanical embodiment and electrical embodiment of the conically converging structure can be produced only with a large amount of effort.

It is also disadvantageous for the pressure stage to be in the form of a conductive, tubular, relatively long container with a relatively large core diameter. A container such as this has an area in which there is no field, as a result of which the radial component of the kinetic energy can lead to defocusing of the secondary ions.

Accordingly, it would be desirable to specify an apparatus for storage and for focusing of ions, and an apparatus for separation of two pressure areas, which are of simple design, on the one hand allow the ions to be focused as well as possible onto a small radius, and on the other hand have good pressure stage characteristics.

SUMMARY OF THE INVENTION

According to the system described herein, an apparatus is provided for focusing and/or storage of ions, for example secondary ions. It is particularly suitable for focusing ions around a predetermined axis within a small radius around the predetermined axis. By way of example, this radius may be in the range from 0.2 mm to 2 mm. Further ranges are mentioned further below.

The apparatus according to the system described herein may have at least one container for holding at least one ion. The container may be, for example, a container in which a gas with gas particles is held and in which the ion transmits energy to the gas particles by impact, such that it is braked to a thermal energy. Alternatively or additionally, the ion may be fragmented by the gas particles, as a result of which it is likewise braked. The container may have at least one outlet, with the outlet being provided in order to transport ions from the container to an analysis unit. The apparatus according to the system described herein furthermore may have at least one multipole unit, for example a quadrupole unit, for providing a multipole alternating field, for example a quadrupole alternating field. The multipole unit may be arranged at the outlet of the container and may have a through-opening with a longitudinal axis. As will also be explained further below, the longitudinal axis may be, for example, in the form of a transport axis. Furthermore, the multipole unit may be provided with a multiplicity of electrodes, specifically with at least one first electrode, at least one second electrode, at least one third electrode, at least one fourth electrode, at least one fifth electrode, at least one sixth electrode, at least one seventh electrode and at least one eighth electrode. The first electrode, the second electrode, the third electrode and the fourth electrode may be at the same radial distance from the longitudinal axis of the through-opening and are each at a first radial distance from the longitudinal axis of the through-opening. Furthermore, the fifth electrode, the sixth electrode, the seventh electrode and the eighth electrode may be at the same radial distance from the longitudinal axis of the through-opening, and may each be at a second radial distance from the longitudinal axis of the through-opening. The first radial distance may be less than the second radial distance.

In particular, the apparatus according to the system described herein may ensure two functions. On the one hand, the multipole alternating field may be made available such that the ions are focused radially in the area of the longitudinal axis of the through-opening. The first electrode, the second electrode, the third electrode, the fourth electrode, the fifth electrode, the sixth electrode, the seventh electrode and the eighth electrode may be connected such that a corresponding multipole alternating field, for example a quadrupole alternating field, is generated. In particular, secondary ions may be focused around the longitudinal axis of the through-opening within a small radius of, for example, in the range from 0.2 mm to 1 mm. This corresponds, for example, approximately to the radial extent of the through-opening. It is therefore then possible to use the apparatus according to the system described herein to create a transition from a first guidance system for ions, which has quite a large core radius (for example in the range from 2 mm to 50 mm) to a second guidance system with a comparatively small core radius (for example in the range from 0.1 mm to 1 mm), without ions inadvertently being reflected back into the container on the apparatus according to the system described herein, or being neutralized on the apparatus according to the system described herein. Furthermore, this prevents axial components of the kinetic energy of the ions from being converted to radial components of the kinetic energy of the ions. The apparatus according to the system described herein may be particularly suitable for use as a pressure stage.

On the other hand, the multipole unit of the apparatus according to the system described herein may be at a suitable potential (referred to in the following text as the mirror potential). This makes it possible for ions which have not yet been braked to thermal energy to be reflected back into the container from the multipole unit, such that they pass through the container once again. This once again results in impacts with the gas particles in the container, as a result of which these reflected ions may still transmit energy. The mirror potential may be switched off as soon as the ions have been brought to the thermal energy.

One embodiment of the apparatus according to the system described herein additionally or alternatively provides for the multipole unit to have a first outer surface which may be defined by a plane. By way of example, the plane may be arranged at right angles to the longitudinal axis. Furthermore, the first electrode, the second electrode, the third electrode, the fourth electrode, the fifth electrode, the sixth electrode, the seventh electrode and the eighth electrode may be arranged on and/or adjacent to the plane.

Furthermore, a further embodiment of the apparatus according to the system described herein additionally or alternatively provides for the multipole unit to have a second outer surface which may be arranged in the opposite direction to the first outer surface of the multipole unit. The first electrode, the second electrode, the third electrode, the fourth electrode, the fifth electrode, the sixth electrode, the seventh electrode and the eighth electrode may extend from the first outer surface to the second outer surface. Alternatively, the first electrode, the second electrode, the third electrode, the fourth electrode, the fifth electrode, the sixth electrode, the seventh electrode and/or the eighth electrode may be arranged on the first outer surface and/or the second outer surface. For example, the first electrode, the second electrode, the third electrode and the fourth electrode may be arranged on the first outer surface. The fifth electrode, the sixth electrode, the seventh electrode and the eighth electrode may be arranged on the second outer surface.

A further embodiment of the apparatus according to the system described herein additionally or alternatively provides for the first outer surface and the second outer surface to be separated such that a distance between the first outer surface and the second outer surface may be in one of the ranges mentioned below: from 0.5 mm to 50 mm, from 0.5 mm to 40 mm, from 0.5 mm to 30 mm, from 0.5 mm to 20 mm, from 0.5 mm to 10 mm, or from 0.5 mm to 3 mm. In one embodiment, the distance may be essentially 1 mm.

In yet another embodiment of the apparatus according to the system described herein, the multipole unit may be in the form of a disk. In this case, a design in the form of a disk is such that the electrodes may be formed by a planar structure which is aligned at right angles to the longitudinal axis. By way of example, the multipole unit may have a predeterminable extent along the longitudinal axis. However, the system described herein is not restricted to an embodiment in the form of a disk. In fact, the multipole unit may also have a different form which is suitable for the system described herein. For example, the multipole unit may be approximately circular. Additionally or as an alternative to this, the first electrode, the second electrode, the third electrode, the fourth electrode, the fifth electrode, the sixth electrode, the seventh electrode, and/or the eighth electrode may be hyperbolic. A more detailed explanation relating to this is provided further below. By way of example, in one embodiment of the apparatus according to the system described herein, the multipole unit may be in the form of a disk and may be provided with 12 or 16 hyperbolic electrodes.

A further embodiment of the apparatus according to the system described herein additionally or alternatively provides for the multipole unit to be formed from at least one printed circuit board. By way of example, the printed circuit board is formed from epoxy resin or a non-conductive material, for example a ceramic or a plastic. Furthermore, the printed circuit board may be formed from a bendable and/or flexible material. The printed circuit board embodiment may be particularly advantageous because of simple manufacturing. For example, the through-opening may be produced with only a small amount of effort, for example by milling out the printed circuit board. Adjacent electrodes may be separated from one another by insulating layers and may be driven, for example by capacitive voltage dividers, such that the multiple alternating field is produced.

A further embodiment of the apparatus according to the system described herein additionally or alternatively provides for the through-opening to have an extent in the radial direction with respect to the longitudinal axis, wherein the extent may be in at least one of the following ranges: from 0.4 mm to 10 mm, from 0.4 mm to 5 mm, or from 0.4 mm to 1 mm.

The system described herein also relates to an apparatus for separating a first pressure area from a second pressure area. The apparatus may therefore be a pressure stage. It is therefore also referred to in the following text as a pressure stage apparatus.

The pressure stage apparatus may have an elongated first opening which extends along an axis. The first opening may be provided with a radial extent from the axis and furthermore may have an axis extent along the axis which is greater than the radial extent. By way of example, the axis extent may be at least 4 times, at least 6 times, at least 8 times, at least 10 times, at least 15 times, at least 20 times, at least 30 times, at least 40 times or at least 50 times greater than the radial extent. At least one first multipole device and at least one second multipole device may be arranged along the axis.

Analyses have shown that the embodiment of the first opening and the arrangement of multipole devices in order to provide multipole alternating fields along the axis as described above may ensure on the one hand that the ions can be focused onto a small radius around the axis, while on the other hand achieve good pressure stage characteristics.

In one embodiment of the system described herein, the pressure stage apparatus alternatively or additionally may have at least one of the following features: the first multipole device may have a first through-opening which is at least part of the first opening, or the second multipole device may have a second through-opening which is at least part of the first opening, or the axis may be in the form of a longitudinal axis.

In a further embodiment of the system described herein, the pressure stage apparatus alternatively or additionally may have at least one of the following features: the first multipole device may be designed to transport a charged particle (for example an ion), or the second multipole device may be designed to transport a charged particle (for example an ion), or the axis may be in the form of a transport axis.

A further embodiment of the pressure stage apparatus additionally or alternatively provides for the pressure stage apparatus to have at least one of the following features: the first multipole device may be in the form of a disk, or the second multipole device may be in the form of a disk. In order to explain the term "in the form of a disk", reference should be made to the comments above and those further below.

A further embodiment of the pressure stage apparatus additionally or alternatively provides for the pressure stage apparatus to have at least one of the following features: the first multipole device may be formed from at least one first printed circuit board, or the second multipole device may be formed from at least one second printed circuit board. The comments already made further above apply in particular to the embodiment, in particular the material, of the abovementioned printed circuit board.

Yet another embodiment of the pressure stage apparatus additionally or alternatively provides for a pumping-out apparatus to be arranged in the area of the second multipole device. This is particularly advantageous when gas particles enter the pressure stage apparatus from the container. These may then be removed again by the pumping-out apparatus, in such a way that they cannot enter the analysis unit.

One embodiment of the pressure stage apparatus additionally or alternatively provides for the radial extent of the first opening to be in at least one of the following ranges: from 0.4 mm to 10 mm, from 0.4 mm to 5 mm, or from 0.4 mm to 1 mm.

Yet another embodiment of the pressure stage apparatus additionally or alternatively provides for the first multipole device and/or the second multipole device each to have at least one first electrode device, at least one second electrode device, at least one third electrode device and at least one fourth electrode device. Alternatively or in addition to this, one embodiment of the pressure stage apparatus provides for the first electrode device, the second electrode device, the third electrode device and/or the fourth electrode device to be hyperbolic. Further details relating to the hyperbolic embodiment are given further below.

One embodiment of the pressure stage apparatus additionally or alternatively provides for the pressure stage apparatus to have at least one of the following features: the first multipole device may have at least one first multipole disk (for example a first quadrupole disk) and at least one second multipole disk (for example a second quadrupole disk), or the second multipole device may have at least one third multipole disk (for example a third quadrupole disk) and at least one fourth multipole disk (for example a fourth quadrupole disk). The reason for this embodiment is as follow. In order to achieve pressure stage characteristics which are as good as possible, it is advantageous for the pressure stage apparatus to be provided with a multiplicity of multipole disks. This is explained further below.

A further embodiment of the pressure stage apparatus additionally or alternatively provides for the pressure stage apparatus to have at least one of the following features: the first multipole disk and the second multipole disk may form a first sealed system, or the third multipole disk and the fourth multipole disk may form a second sealed system. This ensures that the ions may be focused as well as possible onto the longitudinal axis, and that good pressure stage characteristics are achieved.

The system described herein also relates to a particle beam device having a sample chamber, in which a sample is arranged. Furthermore, the particle beam device may have at least one first particle beam column, wherein the first particle beam column may have a first beam generator for generating a first particle beam, and may have a first objective lens for focusing the first particle beam onto the sample. Furthermore, at least one ion generator for generating secondary ions which are emitted from the sample, and at least one collecting apparatus for collection of the secondary ions may be provided on the particle beam device. The collecting apparatus may be used to pass the secondary ions in the direction of at least one analysis unit for analysis of the secondary ions. Furthermore, the particle beam device according to the system described herein may have at least one of the abovementioned apparatuses having at least one of the abovementioned features or having a combination of at least two of the abovementioned features.

By way of example, in the particle beam device according to the system described herein, the first particle beam column may form the ion generator that generates secondary ions, and may be in the form of an ion beam column. However, the system described herein is not restricted to this, as will be explained in more detail further below.

In one embodiment of the particle beam device according to the system described herein, the analysis unit may additionally or alternatively be in the form of a mass spectrometer, for example a time-of-flight mass spectrometer or ion-trap mass spectrometer. In particular, the analysis unit may additionally or alternatively be arranged detachably on one of the abovementioned embodiments of one of the abovementioned apparatuses, by a connecting device. The analysis unit may therefore be designed to be replaceable.

In a further embodiment of the particle beam device according to the system described herein, the particle beam device additionally or alternatively may have a laser unit. By way of example, the ion generator that generates secondary ions may comprise the laser unit. The laser unit may be provided in addition to or as an alternative to the first particle beam column, for generating secondary ions.

Yet another embodiment of the particle beam device according to the system described herein additionally or alternatively provides for the ion generator that generates secondary ions to be arranged on one of the abovementioned apparatuses. For example, the laser unit may be arranged on one of the abovementioned apparatuses such that a laser beam passes through at least one of the abovementioned apparatuses as far as the sample. Additionally or as an alternative to this, the ion generator that generates secondary ions, for example the laser unit, may be arranged on the analysis unit.

In another embodiment of the particle beam device according to the system described herein, a second particle beam column may additionally or alternatively be provided, wherein the second particle beam column may have a second beam generator for generating a second particle beam, and may have a second objective lens for focusing the second particle beam onto the sample. In particular, the second particle beam column may be in the form of an electron beam column, and the first particle beam column may be in the form of an ion beam column. As an alternative to this, the second particle beam column may be in the form of an ion beam column, and the first particle beam column may be in the form of an electron beam column. In a further alternative embodiment, both the first particle beam column and the second particle beam column may each be in the form of an ion beam column.

BRIEF DESCRIPTION OF THE DRAWINGS

Embodiments of the system described herein will be explained in more detail in the following text with reference to the figures, in which.

DETAILED DESCRIPTION OF VARIOUS EMBODIMENTS

Figure 1:
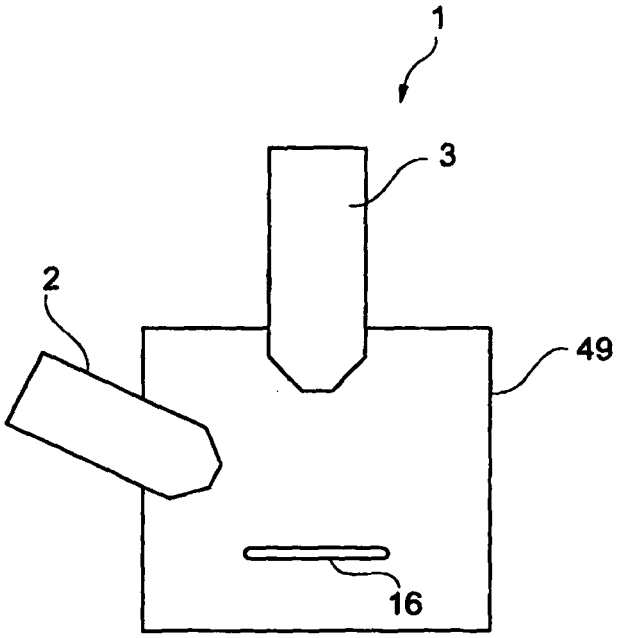
FIG. 1 shows a schematic illustration of a particle beam device according to an embodiment of the system described herein.

FIG. 1 shows a schematic illustration of one embodiment of a particle beam device 1 according to the system described herein. The particle beam device 1 has a first particle beam column 2 in the form of an ion beam column, and a second particle beam column 3 in the form of an electron beam column. The first particle beam column 2 and the second particle beam column 3 are arranged on a sample chamber 49, in which a sample 16 to be examined is arranged. It is explicitly noted that the system described herein is not restricted to the first particle beam column 2 being in the form of an ion beam column and the second particle beam column 3 being in the form of an electron beam column. In fact, the system described herein also provides for the first particle beam column 2 to be in the form of an electron beam column and for the second particle beam column 3 to be in the form of an ion beam column. A further embodiment of the system described herein provides for both the first particle beam column 2 and the second particle beam column 3 each to be in the form of an ion beam column.

Figure 2:
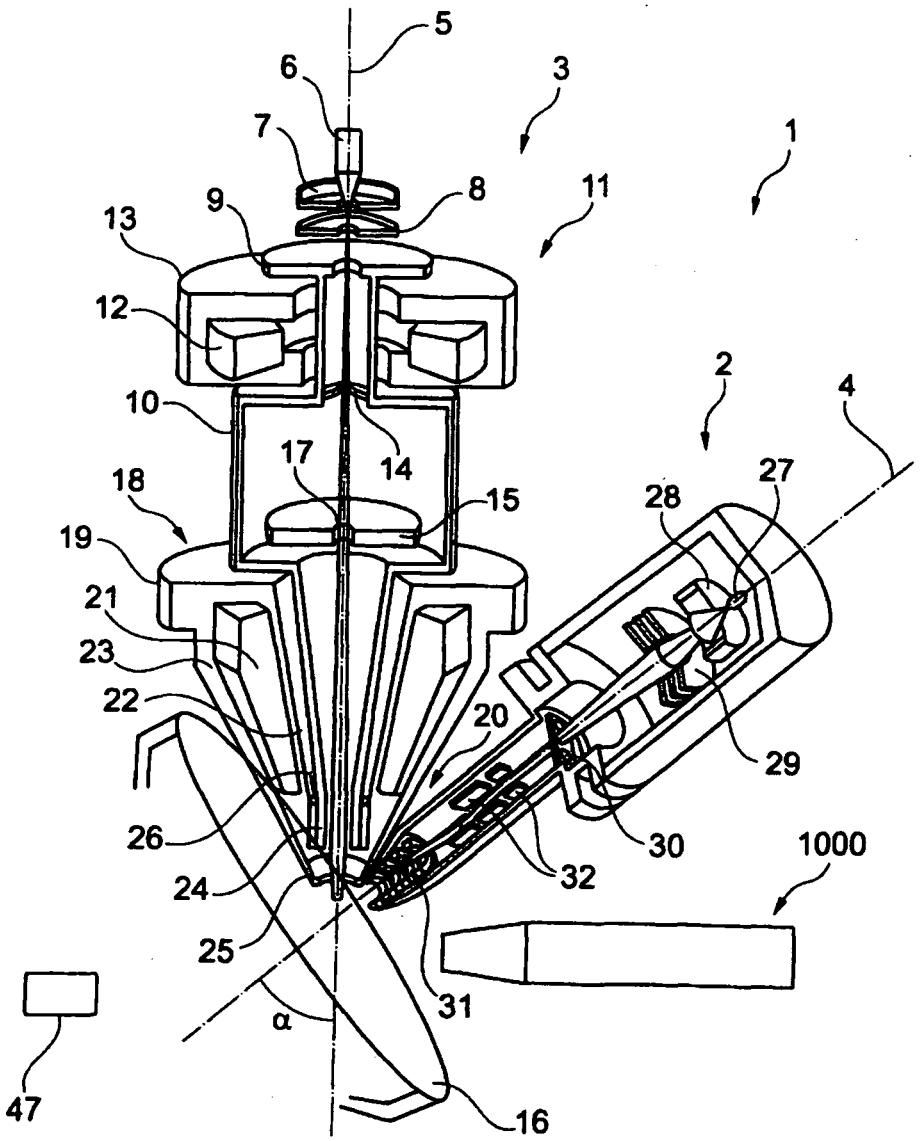
FIG. 2 shows a further schematic illustration of the particle beam device as shown in FIG. 1.

FIG. 2 shows a detailed illustration of the particle beam device 1 shown in FIG. 1. For clarity reasons, the sample chamber 49 is not illustrated. The first particle beam column 2 in the form of the ion beam column has a first optical axis 4. Furthermore, the second particle beam column 3 in the form of the electron beam column has a second optical axis 5.

The second particle beam column 3, in the form of the electron beam column, will now be described first of all in the following text. The second particle beam column 3 has a second beam generator 6, a first electrode 7, a second electrode 8 and a third electrode 9. By way of example, the second beam generator 6 is a thermal field emitter. The first electrode 7 has the function of a suppressor electrode, while the second electrode 8 has the function of an extractor electrode. The third electrode 9 is an anode, and at the same time forms one end of a beam guide tube 10. A second particle beam in the form of an electron beam is generated by the second beam generator 6. Electrons which emerge from the second beam generator 6 are accelerated to the anode potential, for example in the range from 1 kV to 30 kV, as a result of a potential difference between the second beam generator 6 and the third electrode 9. The second particle beam in the form of the electron beam passes through the beam guide tube 10, and is focused onto the sample 16 to be examined. This will be described in more detail further below.

The beam guide tube 10 passes through a collimator arrangement 11 which has a first annular coil 12 and a yoke 13. Seen in the direction of the sample 16, from the second beam generator 6, the collimator arrangement 11 is followed by a pinhole diaphragm 14 and a detector 15 with a central opening 17 arranged along the second optical axis 5 in the beam guide tube 10. The beam guide tube 10 then runs through a hole in a second objective lens 18. The second objective lens 18 is used for focusing the second particle beam onto the sample 16. For this purpose, the second objective lens 18 has a magnetic lens 19 and an electrostatic lens 20. The magnetic lens 19 is provided with a second annular coil 21, an inner pole shoe 22 and an outer pole shoe 23. The electrostatic lens 20 has an end 24 of the beam guide tube 10 and a terminating electrode 25. The end 24 of the beam guide tube 10 and the terminating electrode 25 form an electrostatic deceleration device. The end 24 of the beam guide tube 10, together with the beam guide tube 10, is at the anode potential, while the terminating electrode 25 and the sample 16 are at a potential which is lower than the anode potential. This allows the electrons in the second particle beam to be braked to a desired energy which is required for examination of the sample 16. The second particle beam column 3 furthermore has raster device 26, by which the second particle beam can be deflected and can be scanned in the form of a raster over the sample 16.

For imaging purposes, the detector 15 which is arranged in the beam guide tube 10 detects secondary electrons and/or back-scattered electrons, which result from the interaction between the second particle beam and the sample 16. The signals produced by the detector 15 are transmitted to an electronics unit (not illustrated) for imaging.

The sample 16 is arranged on a sample stage (not illustrated), by which the sample 16 is arranged such that it can move on three axes which arranged to be mutually perpendicular (specifically an x axis, a y axis and a z axis). Furthermore, the sample stage can be rotated about two rotation axes which are arranged to be mutually perpendicular. It is therefore possible to move the sample 16 to a desired position.

As already mentioned above, the reference symbol 2 denotes the first particle beam column, in the form of the ion beam column. The first particle beam column 2 has a first beam generator 27 in the form of an ion source. The first beam generator 27 is used for generating a first particle beam in the form of an ion beam. Furthermore, the first particle beam column 2 is provided with an extraction electrode 28 and a collimator 29. The collimator 29 is followed by a variable aperture 30 in the direction of the sample 16 along the first optical axis 4. The first particle beam is focused onto the sample 16 by a first objective lens 31 in the form of focusing lenses. Raster electrodes 32 are provided, in order to scan the first particle beam over the sample 16 in the form of a raster.

When the first particle beam strikes the sample 16, the first particle beam interacts with the material of the sample 16. In the process, first interaction particles are generated, in particular secondary ions, which are emitted from the sample 16. These are now detected and evaluated by a particle analysis apparatus 1000.

Figure 3:
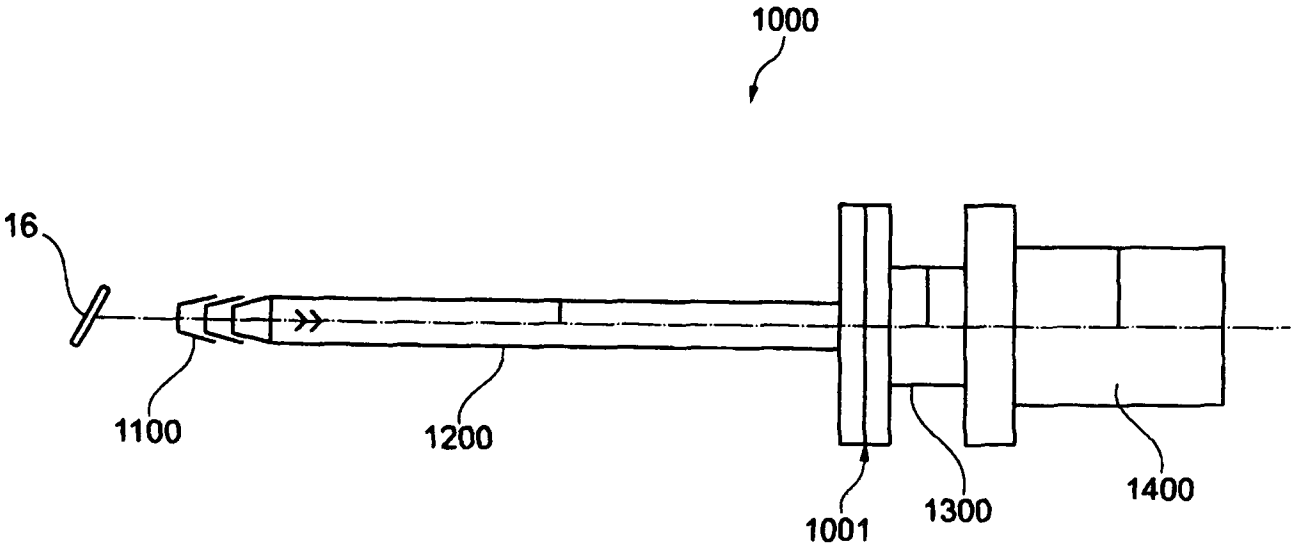
FIG. 3 shows a schematic side view of a particle analysis apparatus according to an embodiment of the system described herein.

FIG. 3 shows a schematic side view of the particle analysis apparatus 1000. The particle analysis apparatus 1000 has a collecting apparatus in the form of an extraction unit 1100, an apparatus for energy transmission 1200, specifically for transmission of energy from the first interaction particles (for example the secondary ions) to neutral gas particles, an ion transmission unit 1300 and an analysis unit 1400. The ion transmission unit 1300 and the analysis unit 1400 are arranged detachably on the sample chamber 49 via a connecting element 1001. This makes it possible to use different analysis units.

The individual units of the particle analysis apparatus 1000 will now be described in more detail in the following text.

Figure 4:
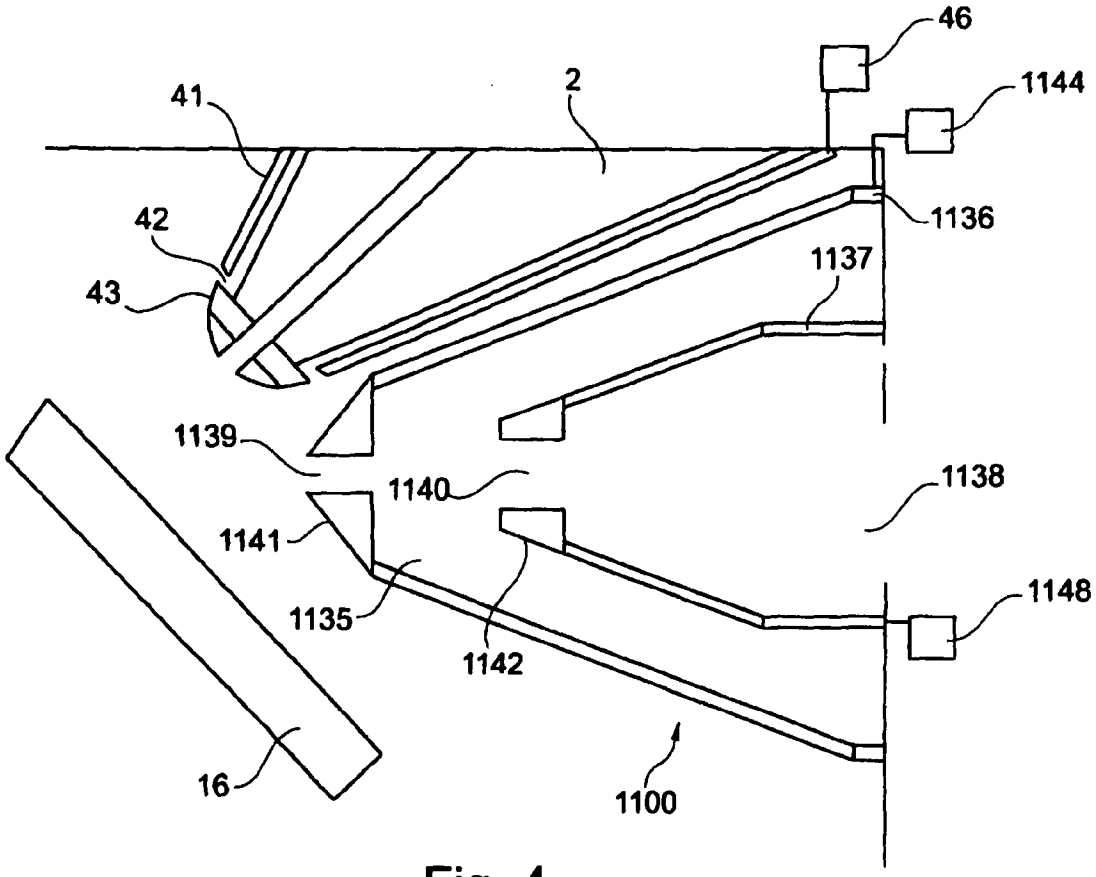
FIG. 4 shows a schematic illustration in the area of a sample as shown in FIG. 2.

FIG. 4 shows a detailed schematic illustration of an area as shown in FIG. 2, specifically the area of the sample 16. The figure shows the extraction unit 1100 and that end of the first particle beam column 2 which is arranged in the area of the sample 16. The secondary ions are emitted virtually throughout the entire hemisphere facing away from the sample 16 and have a non-uniform kinetic energy, that is to say the kinetic energy is distributed. In order to allow a sufficient number of secondary ions to be evaluated, provision is made to inject secondary ions into the particle analysis apparatus 1000 by the extraction unit 1100. The extraction unit 1100 has a first extractor electrode 1136 which is in the form of a first hollow body. This is provided with a first inlet opening 1139 and a first cavity 1135. A second extractor electrode 1137, which is in the form of a second hollow body, is arranged in the first cavity 1135 and has a second inlet opening 1140 and a second cavity 1138. In the exemplary embodiment illustrated here, that end of the first particle beam column 2 which is arranged in the area of the sample 16 is provided with a control electrode 41. Provision is made for the control electrode 41 to partially or completely surround the first particle beam column 2. Furthermore, the control electrode 41 is arranged in a recess 42 on an outer surface 43 of the first particle beam column 2. An outer surface of the control electrode 41 and the outer surface 43 of the first particle beam column 2 form a continuous surface. It is explicitly noted that the system described herein is not restricted to an arrangement of the control electrode 41 such as this. In fact, any suitable arrangement of the control electrode 41 may be used. For example, the control electrode can be placed on the outer surface 43 of the first particle beam column 2.

As mentioned above, the illustration in FIG. 4 should be regarded as a schematic illustration. The individual elements shown in FIG. 4 are illustrated in a greatly exaggerated form, in order to illustrate them better. It is noted that, in particular, the first cavity 1135 may be quite small, in particular such that the distance between the second inlet opening 1140 and the first inlet opening 1139 is quite short (for example in the range from 1 mm to 15 mm, in particular 10 mm).

The first extractor electrode 1136 is at a first extractor potential. A first extractor voltage is a first potential difference between the first extractor potential and the sample potential. In this exemplary embodiment, ground potential (0 V) is used as the sample potential, although the sample potential is not restricted to ground potential. In fact, it may also assume a different value. The first extractor voltage, and therefore the first extractor potential, can be adjusted by a first voltage supply unit 1144.

Provision is also made for the second extractor electrode 1137 to be at a potential, specifically at a second extractor potential. A second extractor voltage is a second potential difference between the second extractor potential and the sample potential. The second extractor voltage and therefore the second extractor potential can be adjusted by a second voltage supply unit 1148. The first extractor potential and the second extractor potential may be of the same magnitude. In further embodiments, the first extractor potential and the second extractor potential have different magnitudes.

In a further embodiment, a first end section 1141 of the first extractor electrode 1136 is at the first extractor potential, while in contrast the rest of the first extractor electrode 1136 is at a potential which differs from this (for example ground potential). It is also possible for a second end section 1142 of the second extractor electrode 1137 to be at the second extractor potential while, in contrast, the rest of the second extractor electrode 1137 is at a potential which is different from this (for example ground potential).

The control electrode 41 is also at a potential, specifically the control electrode potential. A control electrode voltage is a third potential difference between the control electrode potential and the sample potential. The control electrode voltage and therefore the control electrode potential can be adjusted by a third voltage supply unit 46.

A somewhat similar situation applies to the terminating electrode 25 for the second particle beam column 3. The terminating electrode 25 is at a potential, specifically the terminating electrode potential. A terminating electrode voltage is a fourth potential difference between the terminating electrode potential and the sample potential. The terminating electrode voltage and therefore the terminating electrode potential can be adjusted by a fourth voltage supply unit 47 (cf. FIG. 2).

The sample potential, the first extractor potential, the second extractor potential, the control electrode potential and/or the terminating electrode potential are now matched to one another such that an extraction field is generated, which ensures that a sufficient quantity of first interaction particles in the form of secondary ions passes through the first inlet opening 1139 in the first cavity 1135 of the first extractor electrode 1136, and through the second inlet opening 1140 in the second cavity 1138 of the second extractor electrode 1137.

Hard-vacuum conditions are used to generate the secondary ions by the ion beam. Since—as is also explained in more detail further below—the apparatus for energy transmission 1200 is operated in soft-vacuum conditions, the first extractor electrode 1136 and the second extractor electrode 1137 each have the function of a pressure stage. The larger the first inlet opening 1139 is in the first extractor electrode 1136, the more secondary ions can be injected into the particle analysis apparatus 1000. The same situation applies to the second inlet opening 1140 in the second extractor electrode 1137. However, if the first inlet opening 1139 and/or the second inlet opening 1140 are/is quite large, this reduces the effect of the first extractor electrode 1136 and of the second extractor electrode 1137, which act as pressure stages. Furthermore, the extraction field is also reduced. This can be compensated for by additionally amplifying the extraction field. However, this could lead to the secondary ions being supplied with additional kinetic energy.

Furthermore, the second extractor electrode 1137 is used to introduce the secondary ions into the downstream apparatus for energy transmission 1200, focused as well as possible. It has been found that a focusing effect of the second extractor electrode 1137 becomes greater the higher the second extractor potential is chosen to be.

As already mentioned above, the sample potential in this embodiment is ground potential. Furthermore, the first extractor potential and/or the second extractor potential are/is in the range from (−20) V to (−500) V, the control electrode potential is in the range from 200 V to 800 V, and/or the terminating electrode potential is in the range from (0 V) to (−120 V).

Figure 5A:
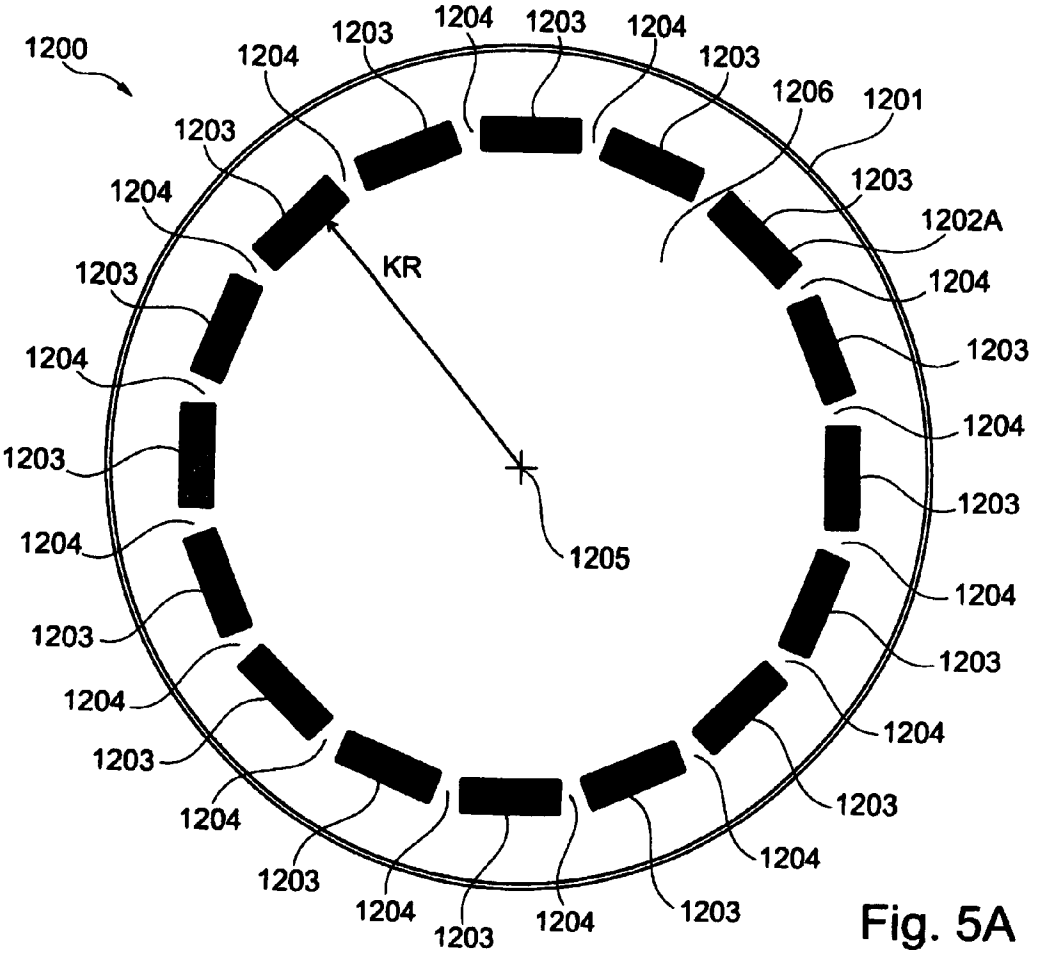
FIG. 5A shows a schematic illustration of an apparatus for energy transmission according to an embodiment of the system described herein.
Figure 5B:
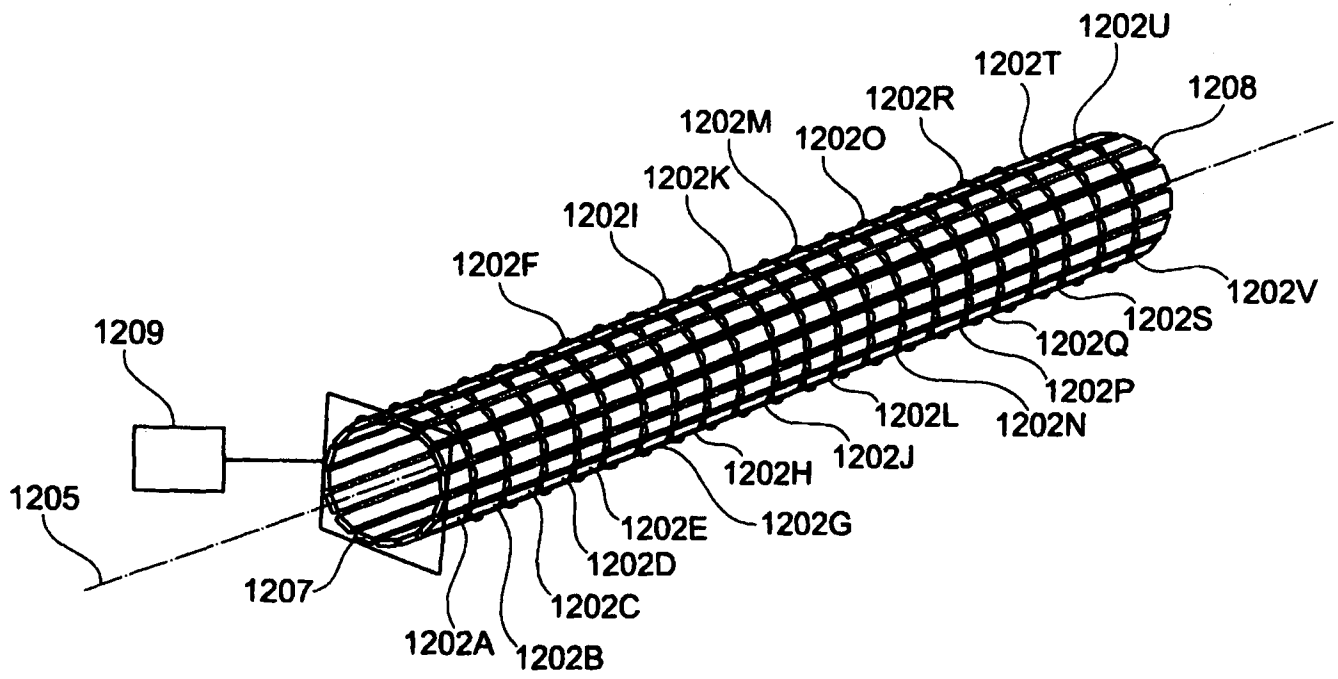
FIG. 5B shows a further schematic illustration of the apparatus for energy transmission as shown in FIG. 5A.

FIGS. 5A and 5B show a schematic illustration of the apparatus for energy transmission 1200. As will be explained in more detail in the following text, it is also used to transport secondary ions.

The apparatus for energy transmission 1200 has a tubular container 1201, which has a first container end 1207 and an area 1208 of a segment (twenty second segment 1202V), which will be explained further below. Along a transport axis in the form of a first longitudinal axis 1205, the tubular container 1201 has a longitudinal extent which is in the range from 100 mm to 500 mm, or in the range from 200 mm to 400 mm. For example, the tubular container 1201 has a longitudinal extent of 350 mm.

The first container end 1207 is connected to the extraction unit 1100. In contrast, the area 1208 is arranged on the ion transmission unit 1300.

The tubular container 1201 has a first internal area 1206. A flexible printed circuit board is arranged on one wall of the first internal area 1206 and is subdivided along the first longitudinal axis 1205 of the tubular container 1201 into numerous segments, specifically into a first segment 1202A, a second segment 1202B, a third segment 1202C, a fourth segment 1202D, a fifth segment 1202E, a sixth segment 1202F, a seventh segment 1202G, an eighth segment 1202H, a ninth segment 1202I, a tenth segment 1202J, an eleventh segment 1202K, a twelfth segment 1202L, a thirteenth segment 1202M, a fourteenth segment 1202N, a fifteenth segment 1202O, a sixteenth segment 1202P, a seventeenth segment 1202Q, an eighteenth segment 1202R, a nineteenth segment 1202S, a twentieth segment 1202T, a twenty first segment 1202U, and a twenty second segment 1202V. Each of the abovementioned segments has printed circuit board electrodes 1203, which are arranged on the flexible printed circuit board. The material from which the flexible printed circuit board is formed is non-conductive. An insulation element 1204 is in each case arranged between two printed circuit board electrodes 1203, and is formed from the non-conductive material. By way of example, the first segment 1202A, which is shown in FIG. 5B, is illustrated in the form of a section drawing in FIG. 5A. The printed circuit board electrodes 1203 and the insulation elements 1204 are arranged over the entire circumference of the first internal area 1206.

Figure 5C:
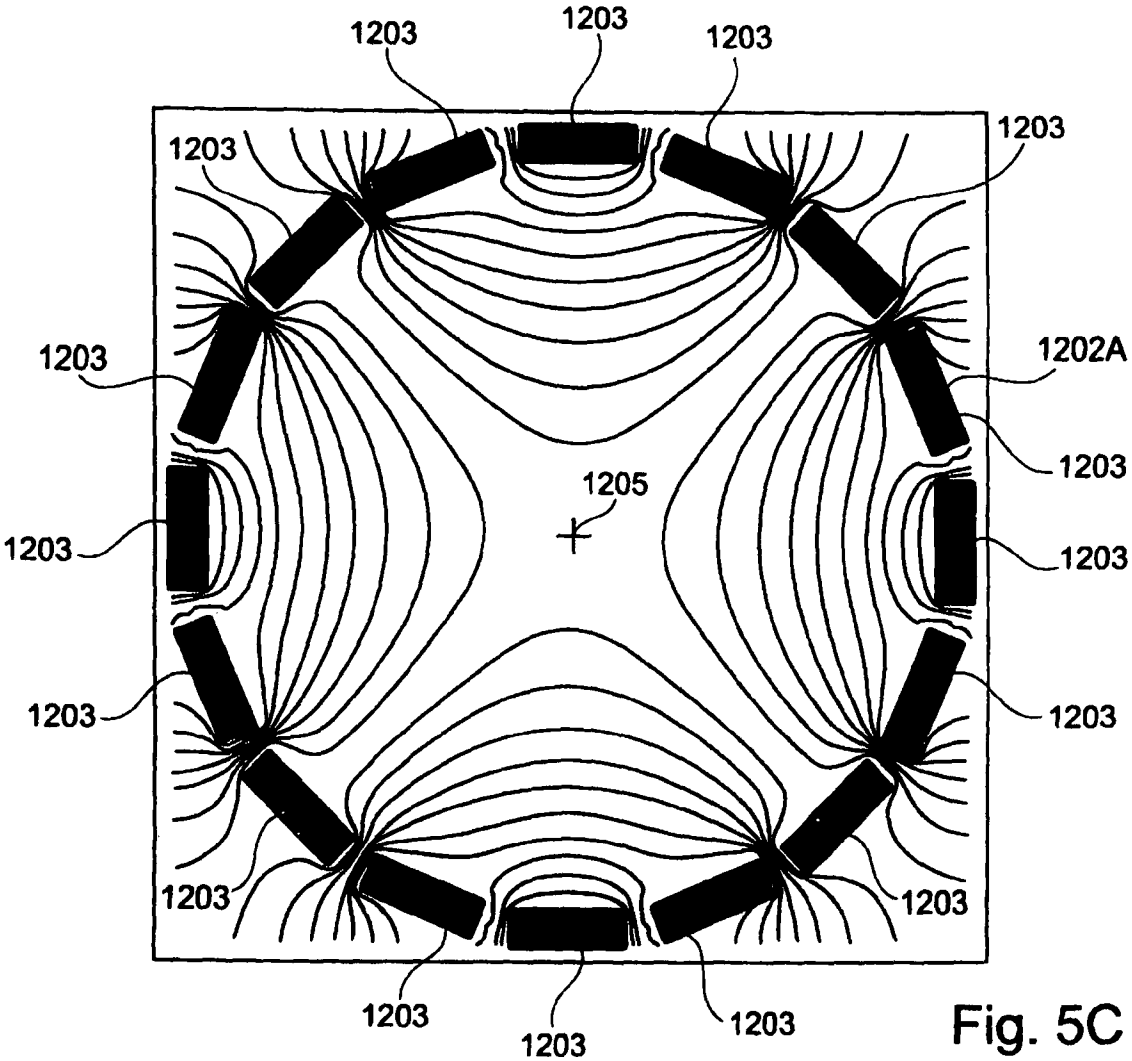
FIG. 5C shows a schematic illustration of a quadrupole alternating field which is generated by the apparatus for energy transmission as shown in FIG. 5B.

Each individual one of the abovementioned segments 1202A to 1202V in its own light represents a quadrupole unit, which electrically simulates a quadrupole alternating field. This means that one segment 1202A to 1202V in each case generates a quadrupole alternating field by the application of potentials to the printed circuit electrodes 1203 of the individual abovementioned segments 1202A to 1202V. In this case, each of the abovementioned segments 1202A to 1202V is designed such that the quadrupole alternating field of each of the abovementioned segments 1202A to 1202V is identical. FIG. 5C shows a schematic illustration of the quadrupole alternating field with lines of equipotential for the first segment 1202A.

In particular, contact is made with individual elements of the flexible printed circuit board via conductor tracks which are arranged in the flexible printed circuit board and are already present. This is a simple form of connection.

At this point, it is expressly noted that the system described herein is not restricted to the use of a single flexible printed circuit board. In fact, the system described herein also allows the use of a plurality of flexible printed circuit boards. For example, individual ones or all of the abovementioned segments 1202A to 1202V may each be formed from a flexible printed circuit board.

The first internal area 1206 of the tubular container 1201 is circular and has a core radius KR. The core radius KR is, for example, in the range from 2 mm to 50 mm, or in the range from 8 mm to 20 mm, or in the range from 9 mm to 12 mm. By way of example, the core radius KR is 15 mm, 10 mm, 9 mm or 8 mm.

Each individual one of the abovementioned segments 1202A to 1202V has a longitudinal extent in the direction of the first longitudinal axis 1205, which may correspond approximately to the core radius KR. As mentioned above, the length of the segments should be oriented on the core radius. The arrangement of the printed circuit board electrodes 1203 as described above allows a larger core radius KR to be achieved than in the case of known systems from the prior art, which use bar electrodes.

The first internal area 1206 of the tubular container 1201 is filled with a gas which has gas particles. The partial pressure of the gas in the first internal area 1206 can be adjusted by a supply device, which is not illustrated.

The secondary ions which enter the first internal area 1206 of the tubular container 1201 from the extraction unit 1100 transmit a portion of their kinetic energy to the neutral gas particles by impacts. This decreases the energy of the secondary ions. The secondary ions are braked. In order to achieve a sufficiently high impact rate to reduce the energy, there is a soft vacuum, for example in the region of $5\times10^{-3}$ mbar ($5\times10^{-1}$ Pa), in the first internal area 1206 of the tubular container 1201. The higher the partial pressure of the gas in the first internal area 1206 of the tubular container 1201 is, the greater is the impact rate, and accordingly also the capability to transmit energy from the secondary ions to the gas particles. After passing through the tubular container 1201 from the first container end 1207 to the area 1208, the secondary ions generally still have only thermal energy.

A further embodiment additionally or alternatively provides for the secondary ions which enter the first internal area 1206 of the tubular container 1201 from the extraction unit 1100 to strike the neutral gas particles and to be fragmented, thus likewise reducing the energy of the secondary ions. This process also results in braking of the secondary ions.

As mentioned above, the kinetic energy of the secondary ions can be subdivided on the one hand into a radial component and on the other hand into an axial component. The radial component causes the secondary ions to diverge radially with respect to the first longitudinal axis 1205 of the tubular container 1201. This divergence is reduced by the quadrupole alternating field. The quadrupole alternating field results in the secondary ions being stored in a small radius around the first longitudinal axis 1205, along the first longitudinal axis 1205 of the tubular container 1201. To be more precise, the impacts of the secondary ions with the gas particles and/or the fragmentation mentioned above result/results in the radial component of the kinetic energy being reduced, as a result of which the amplitude of the above mentioned macro-oscillation is reduced, and the secondary ions are focused onto the first longitudinal axis 1205 of the tubular container 1201.

Figure 6:
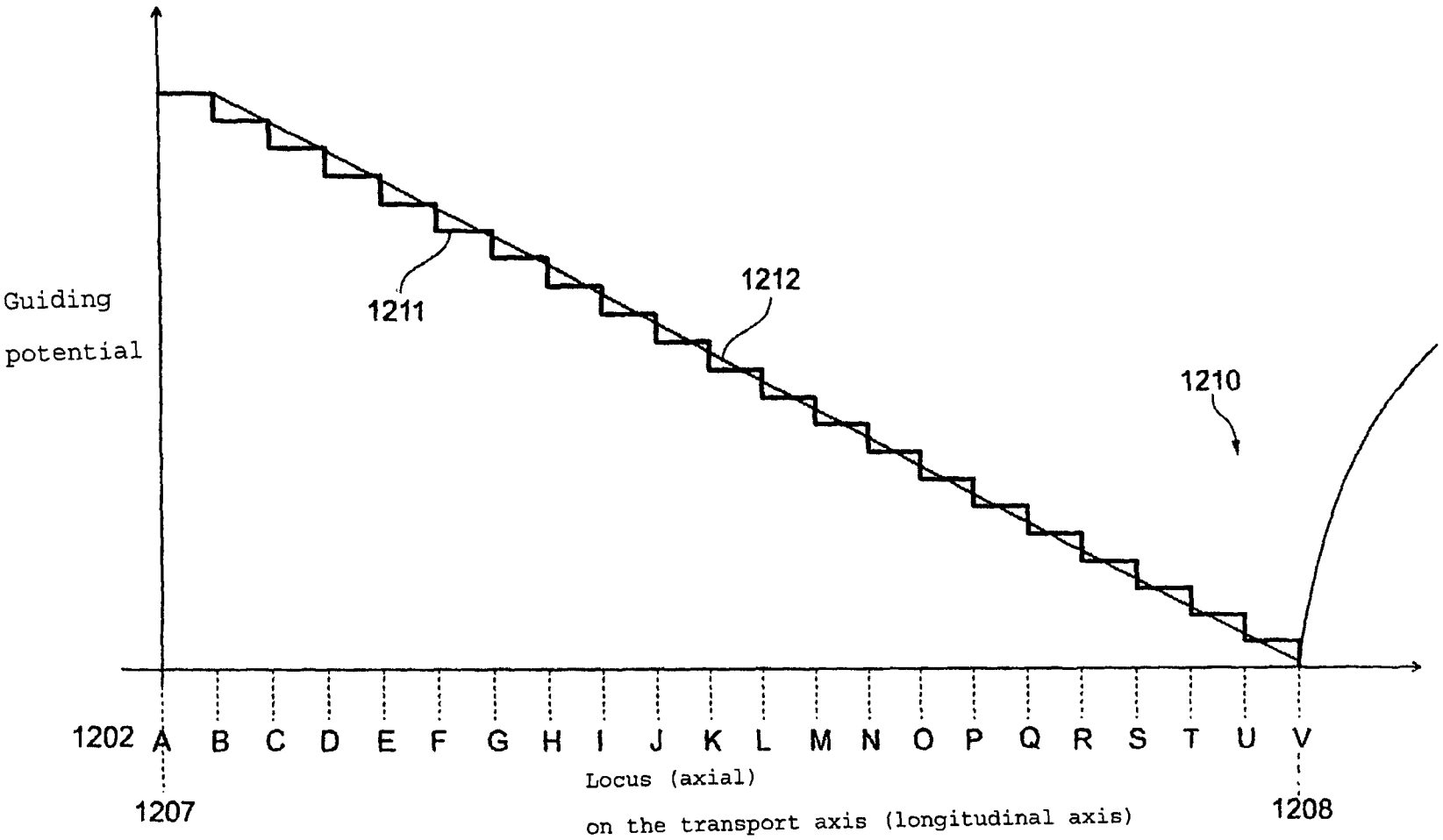
FIG. 6 shows a schematic illustration of a profile of a guiding potential according to an embodiment of the system described herein.

The axial component of the kinetic energy ensures that the secondary ions pass through the tubular container 1201 along the first longitudinal axis 1205 of the tubular container 1201 in the direction of the ion transmission unit 1300. The abovementioned impacts and/or the abovementioned fragmentation also reduce the axial kinetic energy, however, as a result of which the energy of some secondary ions is no longer sufficient to pass completely through the tubular container 1201. Each individual one of the abovementioned segments 1202A to 1202V is therefore connected to a second electronic circuit 1209 (cf. FIG. 5B) such that a guiding potential gradient is produced along the first longitudinal axis 1205 of the tubular container 1201, with a guiding potential associated with that point being provided at each point on the first longitudinal axis 1205. The secondary ions are moved axially along the first longitudinal axis 1205 in the direction of the area 1208 of the tubular container 1201 by the guiding potential gradient. The guiding potential gradient is designed such that the guiding potential decreases continuously in the direction of the area 1208, and has a potential well 1210 in the area 1208. FIG. 6 shows the profile of the guiding potential 1212. The graph shows the guiding potential 1212 as a function of the locus along the first longitudinal axis 1205. A respectively different potential, which is constant over time, is applied to the printed circuit board electrodes of each of the abovementioned segments 1202A to 1202V which are arranged along the transport axis (in this case the first longitudinal axis 1205). This is illustrated by the stepped profile of the segment potentials 1211 in FIG. 6. The stepped profile results essentially in the profile of the guiding potential 1212. The guiding potential 1212 is at its maximum at the first container end 1207 of the tubular container 1201, and decreases continuously in the direction of the area 1208. The potential well 1210 is provided in the area 1208 of the tubular container 1201. The secondary ions pass through the tubular container 1201 and in the process transmit their energy to the gas particles, until they remain in the potential well 1210. It is explicitly noted that the potential well 1210 can also be provided at a different point. For example, in a further exemplary embodiment, the potential well 1210 is arranged behind the area 1208, in the area of the ion transmission unit 1300. A notable factor is that the secondary ions transmit their energy as they pass through the tubular container 1201, and rest in the potential well 1210.

The amplitude of the macro-oscillation can be reduced by transmission of a sufficiently large amount of energy from the secondary ions to the gas particles. In contrast, the amplitude of the micro-oscillation can be reduced by increasing the frequency of the quadrupole alternating field of each of the individual ones of the abovementioned segments 1202A to 1202V. However, this reduces the restoring forces acting on the secondary ions in the tubular container 1201, as a result of which a greater amplitude of the quadrupole alternating field is required in order to reliably store the secondary ions in the tubular container 1201.

Figure 7:
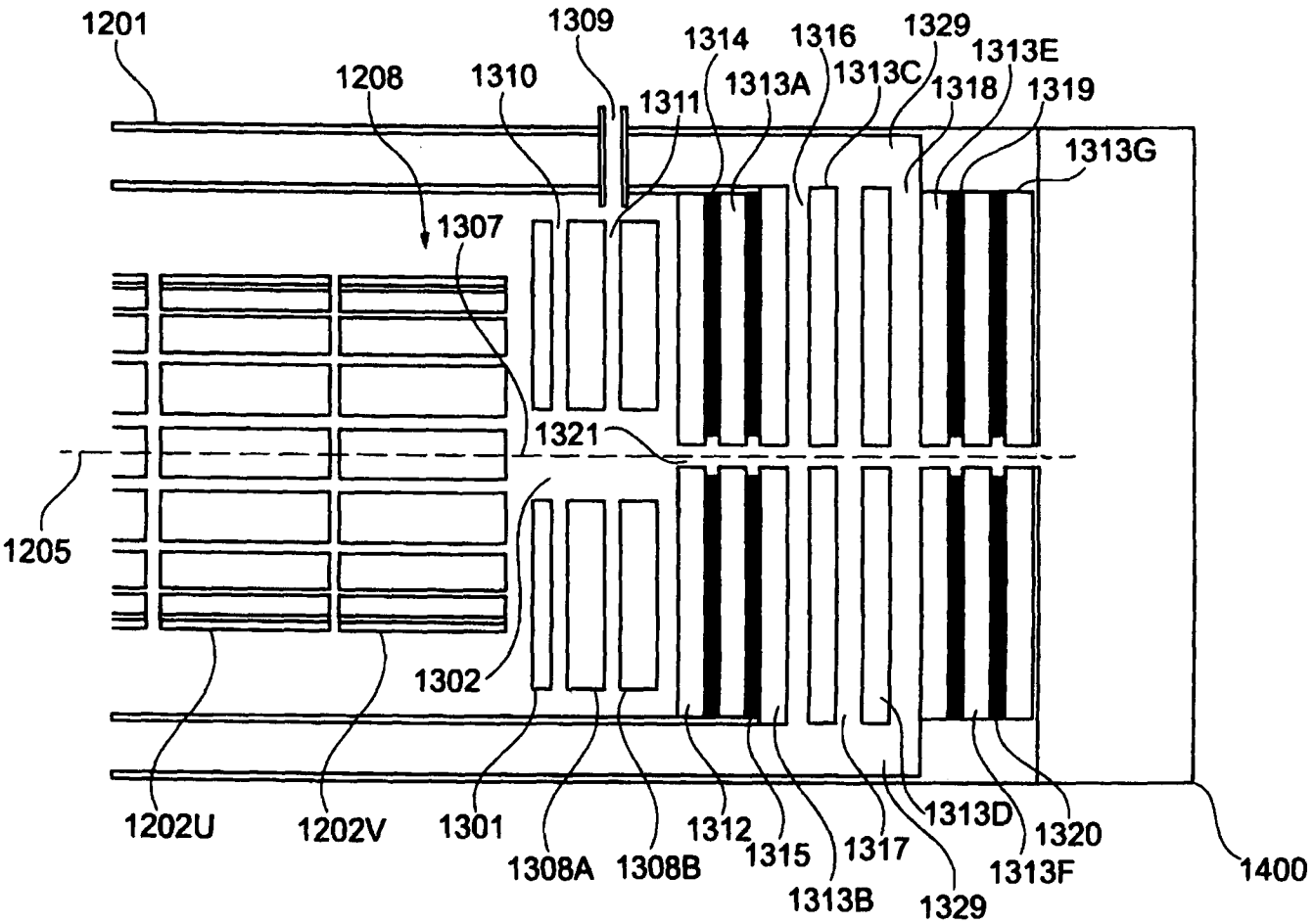
FIG. 7 shows a schematic illustration of one end of the apparatus for energy transmission as shown in FIG. 5B, of an ion transmission unit and of an analysis unit.
Figure 8:
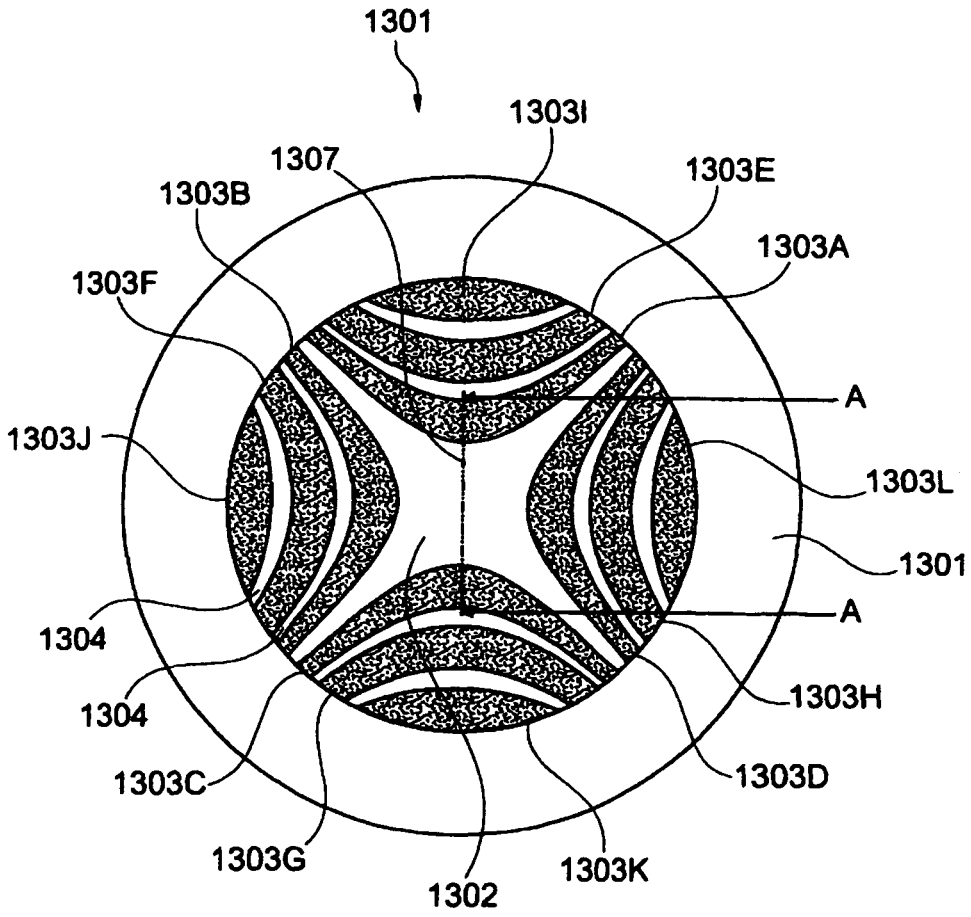
FIG. 8 shows a plan view of a quadrupole disk as shown in FIG. 7.

FIG. 7 shows the area 1208, in which case the abovementioned segments 1202A to 1202V are in this embodiment not arranged directly adjacent to the inner wall of the tubular container 1201. As is shown in FIG. 7, a first quadrupole disk 1301 is arranged in the area 1208. The first quadrupole disk 1301 is multi-hyperbolic. This means that it is provided with a multiplicity of hyperbolic printed circuit board electrodes. As an alternative to this, the printed circuit board electrodes are semicircular. The first quadrupole disk 1301 is in the form of a disk. An embodiment in the form of a disk may be such that the hyperbolic printed circuit board electrodes are formed by a planar structure which is aligned at right angles to the transport axis (in the form of the first longitudinal axis 1205 or a second longitudinal axis 1307). The first quadrupole disk 1301 has a predeterminable extent along the transport axis. This will be explained in more detail in the following text. In the exemplary embodiment described here, the first quadrupole disk 1301 is provided with twelve hyperbolic printed circuit board electrodes. FIG. 8 shows a plan view of the first quadrupole disk 1301. The first quadrupole disk 1301 has a first hyperbolic printed circuit board electrode 1303A, a second hyperbolic printed circuit board electrode 1303B, a third hyperbolic printed circuit board electrode 1303C, a fourth hyperbolic printed circuit board electrode 1303D, a fifth hyperbolic printed circuit board electrode 1303E, a sixth hyperbolic printed circuit board electrode 1303F, a seventh hyperbolic printed circuit board electrode 1303G, an eighth hyperbolic printed circuit board electrode 1303H, a ninth hyperbolic printed circuit board electrode 1303I, a tenth hyperbolic printed circuit board electrode 1303J, an eleventh hyperbolic printed circuit board electrode 1303K and a twelfth hyperbolic printed circuit board electrode 1303L. As mentioned above, all the abovementioned printed circuit board electrodes 1303A to 1303L are hyperbolic. Both in the text above and that below as well, this means that two hyperbolic electrodes (in this case the printed circuit board electrodes 1303A to 1303L) which are arranged opposite one another and whose apex points are at the same distance from the transport axis (in this case the second longitudinal axis 1307) (for example the first hyperbolic printed circuit board electrode 1303A and the third hyperbolic printed circuit board electrode 1303C) comply with the hyperbola equation:

$$\frac{x^2}{a^2} - \frac{y^2}{b^2} = 1 \qquad [3]$$

where x and y are Cartesian coordinates and a and b are the distances between the apex points of the respective electrodes and the transport axis. Adjacent printed circuit board electrodes are each isolated from one another by an insulating layer 1304, as is illustrated by way of example in FIG. 8 for the second hyperbolic printed circuit board electrode 1303B, for the sixth hyperbolic printed circuit board electrode 1303F and for the tenth hyperbolic printed circuit board electrode 1303J. However, the situation is also identical for each of the further abovementioned printed circuit board electrodes 1303A, 1303E, 1303I, 1303C, 1303G, 1303K, 1303D, 1303H and 1303L. Furthermore, adjacent hyperbolic printed circuit board electrodes are driven, for example, by capacitive voltage dividers (not illustrated) such that a quadrupole alternating field is generated. However, the system described herein is not restricted to the use of capacitive voltage dividers. In fact, any suitable drive can be used, for example in each case by one power supply unit for each of the abovementioned hyperbolic printed circuit board electrodes 1303A to 1303L.

The first quadrupole disk 1301 has a first through-opening 1302 which is bounded by an apex point of the first hyperbolic printed circuit board electrode 1303A, an apex point of the second hyperbolic printed circuit board electrode 1303B, an apex point of the third hyperbolic printed circuit board electrode 1303C and an apex point of the fourth hyperbolic printed circuit board electrode 1303D. The use of a printed circuit board for the first quadrupole disk 1301 is particularly advantageous, because it is simple to manufacture. For example, the first through-opening 1302 can be produced with little effort, for example by milling out the printed circuit board. The first through-opening 1302 has an extent in the radial direction with respect to the transport axis, which continues with respect to the first longitudinal axis 1205 of the tubular container 1201, in the form of the second longitudinal axis 1307 of the first through-opening 1302. The extent is in this case the distance between two of the abovementioned apex points which are arranged opposite one another, with the extent being in at least one of the following ranges: from 0.2 mm to 10 mm, from 0.2 mm to 5 mm, or from 0.2 mm to 1 mm.

The first hyperbolic printed circuit board electrode 1303A, the second hyperbolic printed circuit board electrode 1303B, the third hyperbolic printed circuit board electrode 1303C and the fourth hyperbolic printed circuit board electrode 1303D are at the same radial distance from the second longitudinal axis 1307 of the first through-opening 1302, and are each at a first radial distance from the second longitudinal axis 1307 of the first through-opening 1302, in which case, in the above text and in the following text as well, the radial distance is defined by the distance between the apex point, arranged closest to the second longitudinal axis 1307, of a respective hyperbolic printed circuit board electrode and the second longitudinal axis 1307 of the first through-opening 1302. Furthermore, the fifth hyperbolic printed circuit board electrode 1303E, the sixth hyperbolic printed circuit board electrode 1303F, the seventh hyperbolic printed circuit board electrode 1303G and the eighth hyperbolic printed circuit board electrode 1303H are at the same radial distance from the second longitudinal axis 1307 of the first through-opening 1302, and are each at a second radial distance from the second longitudinal axis 1307 of the first through-opening 1302. Furthermore, the ninth hyperbolic printed circuit board electrode 1303I, the tenth hyperbolic printed circuit board electrode 1303J, the eleventh hyperbolic printed circuit board electrode 1303K and the twelfth hyperbolic printed circuit board electrode 1303L are at the same radial distance from the second longitudinal axis 1307 of the first through-opening 1302, and are each at a third radial distance from the second longitudinal axis 1307 of the first through-opening 1302. The first radial distance is less than the second radial distance. The second radial distance is once again less than the third radial distance.

Figure 9:
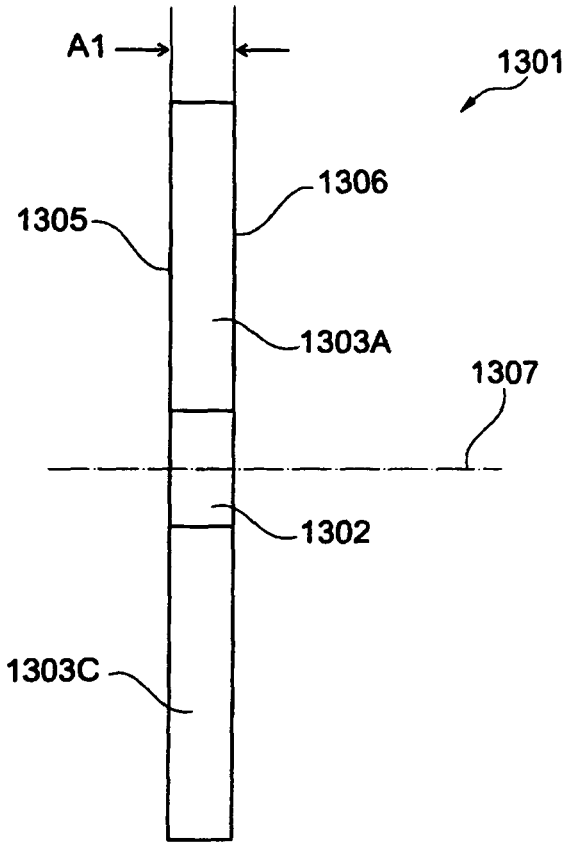
FIG. 9 shows a section illustration through the quadrupole disk along the line A-A in FIG. 8.

FIG. 9 shows a section illustration of the first quadrupole disk 1301 along the line A-A shown in FIG. 8. This schematically illustrates the first hyperbolic printed circuit board electrode 1303A and the third hyperbolic printed circuit board electrode 1303C. The first quadrupole disk 1301 has a first outer surface 1305 and a second outer surface 1306. The first outer surface 1305 and the second outer surface 1306 are separated from one another such that there is a distance A1 between the first outer surface 1305 and the second outer surface 1306 in one of the ranges mentioned in the following text: from 1 mm to 50 mm, from 1 mm to 40 mm, from 1 mm to 30 mm, from 1 mm to 20 mm, or from 1 mm to 5 mm. Even though this is not illustrated explicitly, each of the abovementioned hyperbolic printed circuit board electrodes 1303A to 1303L is arranged on the plane which is formed by the first outer surface 1305, and each may extend from the first outer surface 1305 to the second outer surface 1306.

As can be seen from FIG. 7, the first quadrupole disk 1301 is followed by a first quadrupole device 1308A in the form of a disk and by a second quadrupole device 1308B in the form of a disk. In this case, an embodiment in the form of a disk of each abovementioned quadrupole device and each quadrupole device which is also mentioned in the following text may be such that the electrode devices which are also explained in the following text are formed by a planar structure which is aligned at right angles to the transport axis (in this case the second longitudinal axis 1307). The first quadrupole device 1308A in the form of a disk and the second quadrupole device 1308B in the form of a disk each have four hyperbolic electrode devices in this exemplary embodiment, which each produce a quadrupole alternating field. As an alternative to this, the electrode devices are semicircular. A gas inlet 1309 is arranged at the same height as the first quadrupole device 1308A in the form of a disk and the second quadrupole device 1303B in the form of a disk, through which gas inlet 1309 the gas flows in in order then to interact with the secondary ions, as already explained above. Both the first quadrupole device 1308A in the form of a disk and the second quadrupole device 1308B in the form of a disk have a through-opening which corresponds to the first through-opening 1302.

A first intermediate area 1310 between the first quadrupole disk 1301 and the first quadrupole device 1308A in the form of a disk, as well as a second intermediate area 1311 between the first quadrupole device 1308A in the form of a disk and the second quadrupole device 1308B in the form of a disk are not sealed, thus allowing the gas to be distributed, in particular into the area with the abovementioned segments 1202A to 1202V.

The first quadrupole disk 1301, the first quadrupole device 1308A in the form of a disk and the second quadrupole device 1308B in the form of a disk are on the one hand parts of the apparatus for energy transmission 1200. This means that energy can also be transmitted from the secondary ions to neutral gas particles in the area of the first quadrupole disk 1301, of the first quadrupole device 1308A in the form of a disk and of the second quadrupole device 1308B in the form of a disk. On the other hand, the first quadrupole disk 1301, the first quadrupole device 1308A in the form of a disk and the second quadrupole device 1308B in the form of a disk are also part of the ion transmission unit 1300, however, as will also be explained in more detail further below.

The first quadrupole disk 1301 has at least two functions. On the one hand, the first quadrupole disk 1301 may have a suitable potential applied to it (referred to in the following text as the mirror potential). This makes it possible for secondary ions which have not yet been braked to thermal energy to be reflected back from the first quadrupole disk 1301 into the tubular container 1201, such that they pass through the tubular container 1201 once again. This once again results in impacts in the tubular container 1201 with the gas particles, as a result of which these reflected secondary ions furthermore transmit energy to the neutral gas particles. The guiding potential mentioned above ensures that these secondary ions are once again transported in the direction of the area 1208. The mirror potential is switched off as soon as the secondary ions have been brought to thermal energy.

On the other hand, the first quadrupole disk 1301 is used for focusing secondary ions onto the second longitudinal axis 1307. A potential pulse can be used to lift the secondary ions located in the abovementioned potential well 1210 at the guiding potential into the first through-opening 1302. In an alternative embodiment, the abovementioned potential well 1210 is formed in the area of the first quadrupole disk 1301, the first quadrupole device 1308A in the form of a disk or the second quadrupole device 1308B in the form of a disk.

The first quadrupole disk 1301 ensures that a quadrupole alternating field which stores the secondary ions is made available such that the secondary ions are focused radially in the area of the second longitudinal axis 1307. By way of example, the secondary ions are focused within a small radius of, for example, in the range from 0.2 mm to 5 mm around the second longitudinal axis 1307. This corresponds approximately to the radial extent of the first through-opening 1302. The first quadrupole disk 1301 can accordingly be used to create a transition between a first guide system for secondary ions with quite a large core radius (in this exemplary embodiment the tubular container 1201 with a core radius of, for example, in the range from 5 mm to 15 mm) and a second guide system (which will be explained in more detail further below) with a comparatively small core radius (for example in the range from 0.1 mm to 5 mm), without secondary ions being reflected back into the tubular container 1201 inadvertently at the first quadrupole disk 1301, or being neutralized on the first quadrupole disk 1301. Furthermore, the first quadrupole disk 1301 prevents axial components of the kinetic energy of the secondary ions being converted to radial components of the kinetic energy of the secondary ions.

In order to avoid loss of secondary ions as a result of the secondary ions striking one of the abovementioned hyperbolic printed circuit board electrodes 1303A to 1303D of the first quadrupole disk 1301, a total oscillation amplitude, which is the sum of the amplitude of the macro-oscillation and the amplitude of the micro-oscillation, should remain less than the radius of the first through-opening 1302. If this is not the case, then the first quadrupole disk 1301 has the mirror potential applied to it, such that the secondary ions pass through the tubular container 1201 once again, until they have been brought to thermal energy, as explained above. The first through-opening 1302 is designed such that secondary ions with thermal energy can pass through the first through-opening 1302 without having to meet one of the abovementioned hyperbolic printed circuit board electrodes 1303A to 1303D of the first quadrupole disk 1301.

As already explained above, the potential well 1210 in FIG. 6 may also be provided at a different point. For example, in a further exemplary embodiment, the potential well 1210 is arranged behind the area 1208, in the area of the ion transmission unit 1300. By way of example, the potential well 1210 is formed in the area of the first quadrupole disk 1301, the first quadrupole device 1308A in the form of a disk or the second quadrupole device 1308B in the form of a disk. In this case, by way of example, the second quadrupole device 1308B in the form of a disk is provided with a terminating potential, which is used to generate a potential wall. This potential wall is, for example, part of the potential well 1210.

As can be seen from FIG. 7, a second quadrupole disk 1312 is adjacent to the second quadrupole device 1308B in the form of a disk and is designed to be essentially identical to the first quadrupole disk 1301. However, this design is not absolutely essential. In fact, further embodiments provide for the second quadrupole disk 1312 to be designed, for example, in the same way as the second quadrupole device 1308B in the form of a disk. The second quadrupole disk 1312 is used for focusing the secondary ions onto the second longitudinal axis 1307, which extends through a second through-opening 1321 in the second quadrupole disk 1312. The second through-opening 1321 is smaller than the first through-opening 1302. By way of example, the extent of the second through-opening 1321 is in the range from 0.4 mm to 2 mm.

As mentioned above, the amplitude of the macro-oscillation can be reduced by transmitting a sufficiently large amount of energy from the secondary ions to the gas particles. In contrast, the amplitude of the micro-oscillation can be reduced by increasing the frequency of the quadrupole alternating field. However, this reduces the restoring forces acting on the secondary ions, as a result of which the quadrupole alternating field has to have a greater amplitude in order to reliably store the secondary ions. In order to keep the sudden frequency change between the individual core radii small, it is advantageous to reduce the core radius in two steps (specifically on the one hand with the first quadrupole disk 1301 and on the other hand with the second quadrupole disk 1312).

A third quadrupole device 1313A in the form of a disk, a fourth quadrupole device 1313B in the form of a disk, a fifth quadrupole device 1313C in the form of a disk, a sixth quadrupole device 1313D in the form of a disk, a seventh quadrupole device 1313E in the form of a disk; an eighth quadrupole device 1313F in the form of a disk and a ninth quadrupole device 1313G in the form of a disk are following the second quadrupole disk 1312 along the second longitudinal axis 1307. Each of the abovementioned quadrupole devices 1313A to 1313G in the form of disks in each case has a through-opening which is identical to the second through-opening 1321.

The third quadrupole device 1313A in the form of a disk, the fourth quadrupole device 1313B in the form of a disk, the fifth quadrupole device 1313C in the form of a disk, the sixth quadrupole device 1313D in the form of a disk, the seventh quadrupole device 1313E in the form of a disk, the eighth quadrupole device 1313F in the form of a disk and the ninth quadrupole device 1313G in the form of a disk each have a first electrode device, a second electrode device, a third electrode device and a fourth electrode device. The first electrode device, the second electrode device, the third electrode device and the fourth electrode device are all hyperbolic. Each of the abovementioned quadrupole devices 1313A to 1313G in the form of disks generates a quadrupole alternating field by the electrode devices associated with it.

The first quadrupole disk 1301, the second quadrupole disk 1312, the first quadrupole device 1308A in the form of a disk, the second quadrupole device 1308B in the form of a disk and the third quadrupole device 1313A in the form of a disk to the ninth quadrupole device 1313G in the form of a disk are parts of the ion transmission unit 1300, which will be described in more detail further below. Furthermore, the second quadrupole disk 1312 and the third quadrupole device 1313A in the form of a disk to the ninth quadrupole device 1313G in the form of a disk are additionally, however, also parts of a pressure stage, which will now be explained in following text.

A sufficiently high gas pressure such that the secondary ions can transmit energy to neutral gas particles by impacts is still present in the area of the first quadrupole disk 1301, of the first quadrupole device 1308A in the form of a disk, of the second quadrupole device 1308B in the form of a disk and of the second-quadrupole disk 1312.

The second quadrupole disk 1312, the third quadrupole device 1313A in the form of a disk and the fourth quadrupole device 1313B in the form of a disk form a sealed system. For this purpose, a third intermediate area 1314 between the second quadrupole disk 1312 and the third quadrupole device 1313A in the form of a disk, as well as a fourth intermediate area 1315 between the third quadrupole device 1313A in the form of a disk and the fourth quadrupole device 1313B in the form of a disk are sealed by seals. The seals can be designed as required. By way of example, the seals are in the form of O-rings and/or are electrically insulating. Furthermore, for example, a free internal diameter of the seals can be made larger than the extent of the second through-opening 1321 in order to avoid charges.

The seventh quadrupole device 1313E in the form of a disk, the eighth quadrupole device 1313F in the form of a disk and the ninth quadrupole device 1313G in the form of a disk likewise form a sealed system. For this purpose, an eighth intermediate area 1319 between the seventh quadrupole device 1313E in the form of a disk and the eighth quadrupole device 1313F in the form of a disk, as well as a ninth intermediate area 1320 between the eighth quadrupole device 1313F in the form of a disk and the ninth quadrupole device 1313G in the form of a disk are sealed by seals. The above statements relating to the seals also apply here.

A fifth intermediate area 1316, which is in the form of a pumping-out channel, is arranged between the fourth quadrupole device 1313B in the form of a disk and the fifth quadrupole device 1313C in the form of a disk. Furthermore, a sixth intermediate area 1317, which is likewise in the form of a pumping-out channel, is arranged between the fifth quadrupole device 1313C in the form of a disk and the sixth quadrupole device 1313D in the form of a disk. A seventh intermediate area 1318, which is in the form of a pumping-out channel, is also arranged between the sixth quadrupole device 1313D in the form of a disk and the seventh quadrupole device 1313E in the form of a disk. The abovementioned pumping-out channels are connected via channels 1329 to a pump unit (not illustrated). This is particularly advantageous when gas particles enter the ion transmission unit 1300 from the tubular container 1201. The gas particles are then removed by the pump unit via the abovementioned pumping-out channels, such that they essentially cannot enter the analysis unit 1400.

Furthermore, each of the abovementioned quadrupole devices 1313A to 1313G in the form of disks is in each case formed from a printed circuit board.

The second through-opening 1321 has an extent which is in one of the following ranges: from 0.4 mm to 10 mm, from 0.4 mm to 5 mm, or from 0.4 mm to 2 mm.

The splitting of a pressure stage by the arrangement as described above of the second quadrupole disk 1312, and the abovementioned quadrupole devices 1313A to 1313G which are in the form of disks, in order to generate quadrupole alternating fields ensures that, on the one hand, the secondary ions can be focused in a small area around the second longitudinal axis 1307, and on the other hand that good pressure stage characteristics are achieved. The pressure stage extends essentially over a large proportion of the ion transmission unit 1300.

All of the elements of the ion transmission unit 1300 also have a further function, which will be described in the following text.

Figure 10:
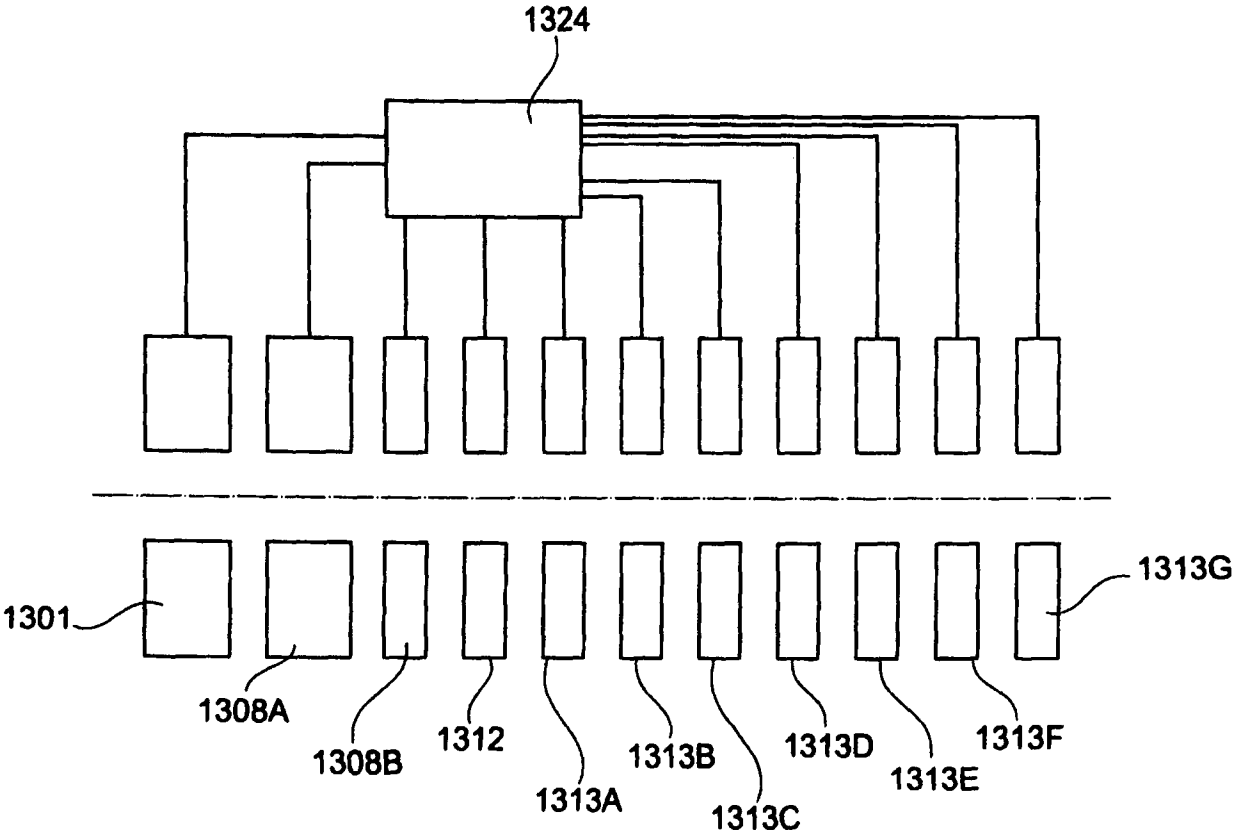
FIG. 10 shows a schematic illustration of the ion transmission unit according to an embodiment of the system described herein.

FIG. 10 once again shows a schematic section illustration of the described elements of the ion transmission unit 1300. The first quadrupole disk 1301, the second quadrupole disk 1312 and also each of the quadrupole devices 1308A, 1308B as well as 1313A to 1313G in the form of disks are each provided with an individual potential, by an electronic circuit 1324. The first quadrupole disk 1301 is therefore provided with a first potential, the second quadrupole disk 1312 with a second potential, the first quadrupole device 1308A in the form of a disk with a third potential, the second quadrupole device 1308B in the form of a disk with a fourth potential, the third quadrupole device 1313A in the form of a disk with a fifth potential, the fourth quadrupole device 1313B in the form of a disk with a sixth potential, the fifth quadrupole device 1313C in the form of a disk with a seventh potential, the sixth quadrupole device 1313D in the form of a disk with an eighth potential, the seventh quadrupole device 1313E in the form of a disk with a ninth potential, the eighth quadrupole device 1313F in the form of a disk with a tenth potential, and the ninth quadrupole device 1313G in the form of a disk with an eleventh potential. The first potential to the eleventh potential can each be set individually.

The quadrupole alternating fields provided in the ion transmission unit 1300 as well as the abovementioned, individually adjustable, first to eleventh potentials, make it possible for the secondary ions which are braked to a thermal energy to be transported into the analysis unit 1400 without kinetic energy being significantly supplied to the secondary ions. For this purpose, the adjustable first to eleventh potentials which are provided in addition to the individual quadrupole alternating fields are set such that potential wells are created. This and the transport will now be explained with reference to a plurality of exemplary embodiments.

Figure 11:
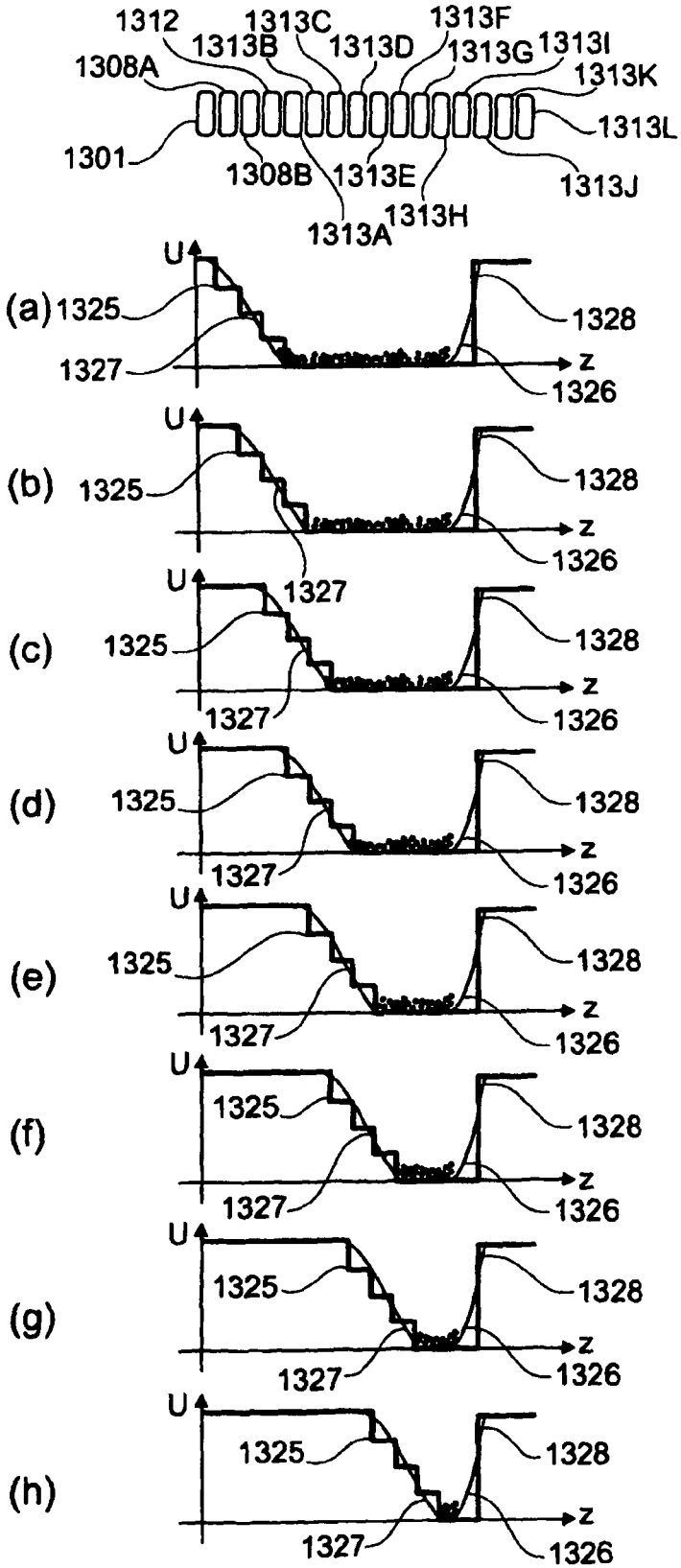
FIG. 11 shows a schematic illustration of a first exemplary embodiment of a potential profile in the ion transmission unit.

FIG. 11 first of all shows a schematic illustration of the first quadrupole disk 1301, the second quadrupole disk 1312 and the quadrupole devices 1308A, 1308B as well as 1313A to 1313G which are in the form of disks. Furthermore, further quadrupole devices in the form of disks are provided, specifically a tenth quadrupole device 1313H in the form of a disk, an eleventh quadrupole device 1313I in the form of a disk, a twelfth quadrupole device 1313J in the form of a disk, a thirteenth quadrupole device 1313K in the form of a disk and a fourteenth quadrupole device 1313L in the form of a disk. The abovementioned quadrupole devices 1313H to 1313L in the form of disks are also each provided with an individual potential by an electronic circuit, for example the electronic circuit 1324. The tenth quadrupole device 1313H in the form of a disk is therefore provided with a twelfth potential, the eleventh quadrupole device 1313I in the form of a disk with a thirteenth potential, the twelfth quadrupole device 1313J in the form of a disk with a fourteenth potential, the thirteenth quadrupole device 1313K in the form of a disk with a fifteenth potential, and the fourteenth quadrupole device 1313L in the form of a disk with a sixteenth potential. The twelfth potential to the sixteenth potential may each be set individually. This is intended to illustrate that the ion transmission unit 1300 can always have more or else fewer than the units illustrated in FIG. 7. The fourteenth quadrupole device 1313L in the form of a disk is then followed by the analysis unit 1400 which, for example, is arranged detachably on the ion transmission unit 1300. However, all of these embodiments always operate in the same way, as will now be explained in the following text.

As explained above, the first to the sixteenth potentials can each be set individually. For this purpose, the corresponding potentials are respectively applied to the individual corresponding quadrupole disks 1301, 1312 and quadrupole devices 1308A, 1308B as well as 1313A to 1313L which are in the form of disks. By way of example, they are set such that the first to the sixteenth potentials are different to one another. The adjustment process is also carried out, for example, by use of charging processes when switching from a first potential value to a second potential value. The adjustment process makes it possible to achieve a specific potential profile in the ion transmission unit 1300. FIGS. 11*a* to 11*h* show the time profile of the total potential, which is composed of the first to the sixteenth potentials, in the ion transmission unit 1300, with FIG. 11*a* showing the earliest instantaneous record of the total potential in time and FIG. 11*h* showing the latest instantaneous record of the total potential in time. The graph shows the potential as a function of the locus on the second longitudinal axis 1307. The reference symbol 1325 denotes a stepped potential profile which occurs when considering one moment in the profile of the total potential. The reference symbol 1326 denotes the ideal potential profile. The first to sixteenth potentials are each switched such that the illustrated profile of the total potential is achieved. The maximum total potential in the exemplary embodiment illustrated here is in the range of a few volts, for example 2 V to 3 V. First of all, FIG. 11*a* shows a potential well, where a left-hand flank 1327 of the potential well is configured such that the secondary ions which still have only thermal energy can fall into the potential well from the area of the first quadrupole disk 1301. A right-hand flank 1328, which is provided in the area of the eleventh quadrupole device 1313I in the form of a disk and the twelfth quadrupole device 1313J in the form of a disk, is designed to be sufficiently steep that the secondary ions can no longer leave the potential well on the right-hand flank 1328. The left-hand flank 1327 is also designed such that the secondary ions can no longer leave the potential well, with the gas pressure in this area still being sufficiently high that the secondary ions can transmit energy to neutral gas particles by impacts. This ensures that the secondary ions can no longer leave the potential well. The state in FIG. 11*a* is now maintained for a predetermined time (for example in the region of a few milliseconds). The secondary ions are collected in the potential well (accumulation of the secondary ions) in this predetermined time (accumulation time). The first to sixteenth potentials are now switched such that the left-hand flank 1327 migrates to the right-hand flank 1328 (FIGS. 11*b* to 11*h*). In consequence, the potential well becomes ever narrower. The secondary ions are likewise forced to move in the direction of the right-hand flank 1328 by this movement of the left-hand flank 1327. In this way, the secondary ions are transported in the ion transmission unit 1300. The first to sixteenth potentials are now switched such that the left-hand flank 1327 and the right-hand flank 1328 are moved along the second longitudinal axis 1307 such that the secondary ions in the potential well move slightly in front of the analysis unit 1400.

Figure 12:
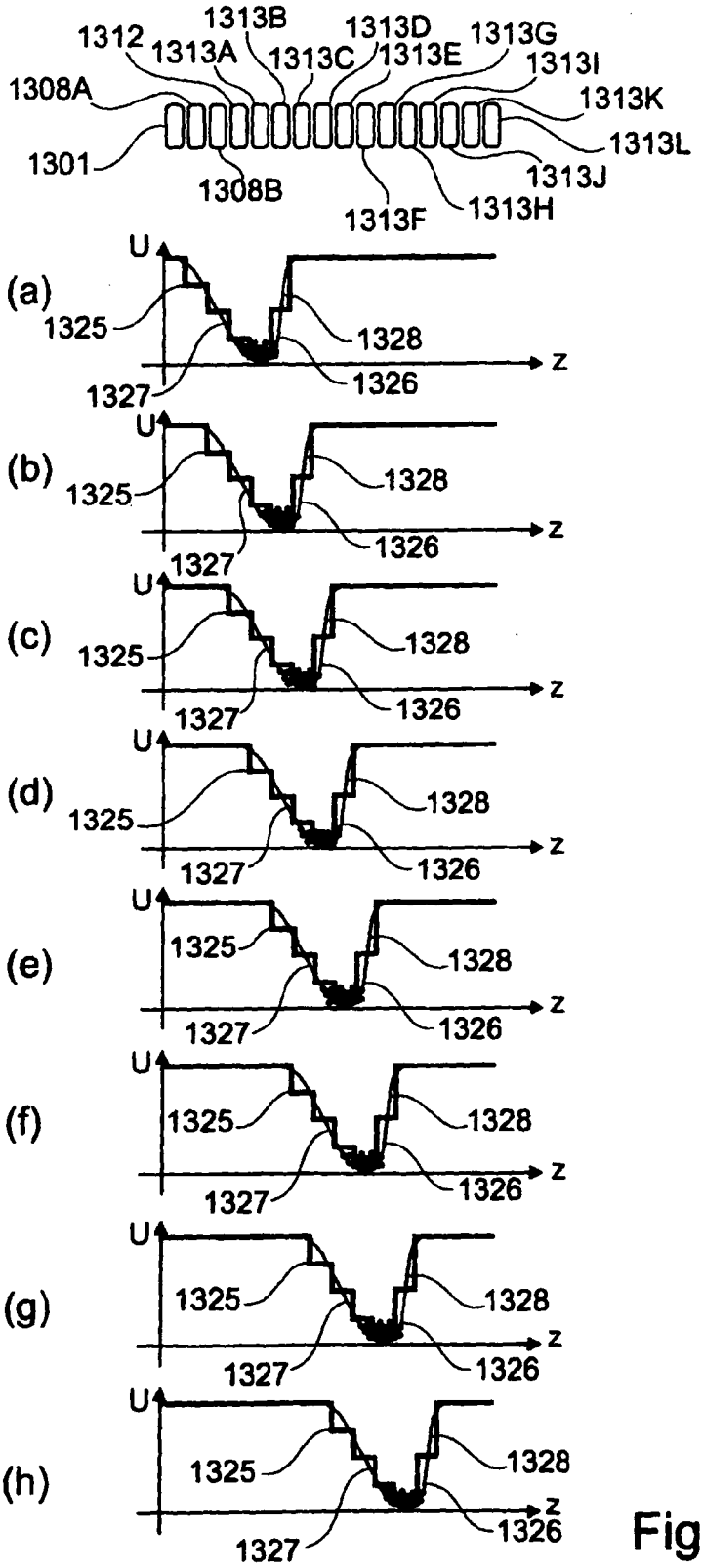
FIG. 12 shows a schematic illustration of a second exemplary embodiment of a potential profile in the ion transmission unit.

FIG. 12 shows a further exemplary embodiment of how the secondary ions are transported in the ion transmission unit 1300. FIG. 12 is based on FIG. 11, as a result of which reference is made first of all to all the above statements. FIGS. 12*a* to 12*h* show the time profile of the total potential, which is composed of the first to sixteenth potentials, in the ion transmission unit 1300, with FIG. 12*a* showing the earliest instantaneous record of the total potential in time, and FIG. 12*h* showing the latest instantaneous record of the total potential in time. The maximum total potential is in this case once again in the region of a few volts, for example 2 V to 3 V. First of all, a potential well is illustrated in FIG. 12*a*, with the left-hand flank 1327 of the potential well being designed such that the secondary ions which still have only thermal energy can fall into the potential well from the area of the first quadrupole disk 1301. The right-hand flank 1328, which is provided in the area of the third quadrupole device 1313A in the form of a disk and the fourth quadrupole device 1313B in the form of a disk, is designed to be sufficiently steep that the secondary ions can no longer leave the potential well on the right-hand flank 1328. The left-hand flank 1327 is also designed such that the secondary ions can no longer leave the potential well, with the gas pressure in this area still being sufficiently high that the secondary ions can transmit energy to neutral gas particles by impacts. This ensures that the secondary ions can no longer leave the potential well. In contrast to FIG. 11*a*, the potential well illustrated in FIG. 12*a* is considerably narrower. The state in FIG. 12*a* is now maintained for a predetermined time (for example in the region of a few milliseconds). The secondary ions are collected in the potential well (accumulation of the secondary ions) in this predetermined time (accumulation time). The first to sixteenth potentials are now switched such that the left-hand flank 1327 and the right-hand flank 1328 are moved along the second longitudinal axis 1307 (FIGS. 12*b* to 12*h*). The potential well in which the secondary ions are located is therefore also moved. The secondary ions are forced to move in the direction of the analysis unit 1400 by this movement of the left-hand flank 1327 and of the right-hand flank 1328. In this way, the secondary ions are transported in the ion transmission unit 1300. The movement of the left-hand flank 1327 and of the right-hand flank 1328 continues until the secondary ions are located slightly in front of the analysis unit 1400.

Figure 13:
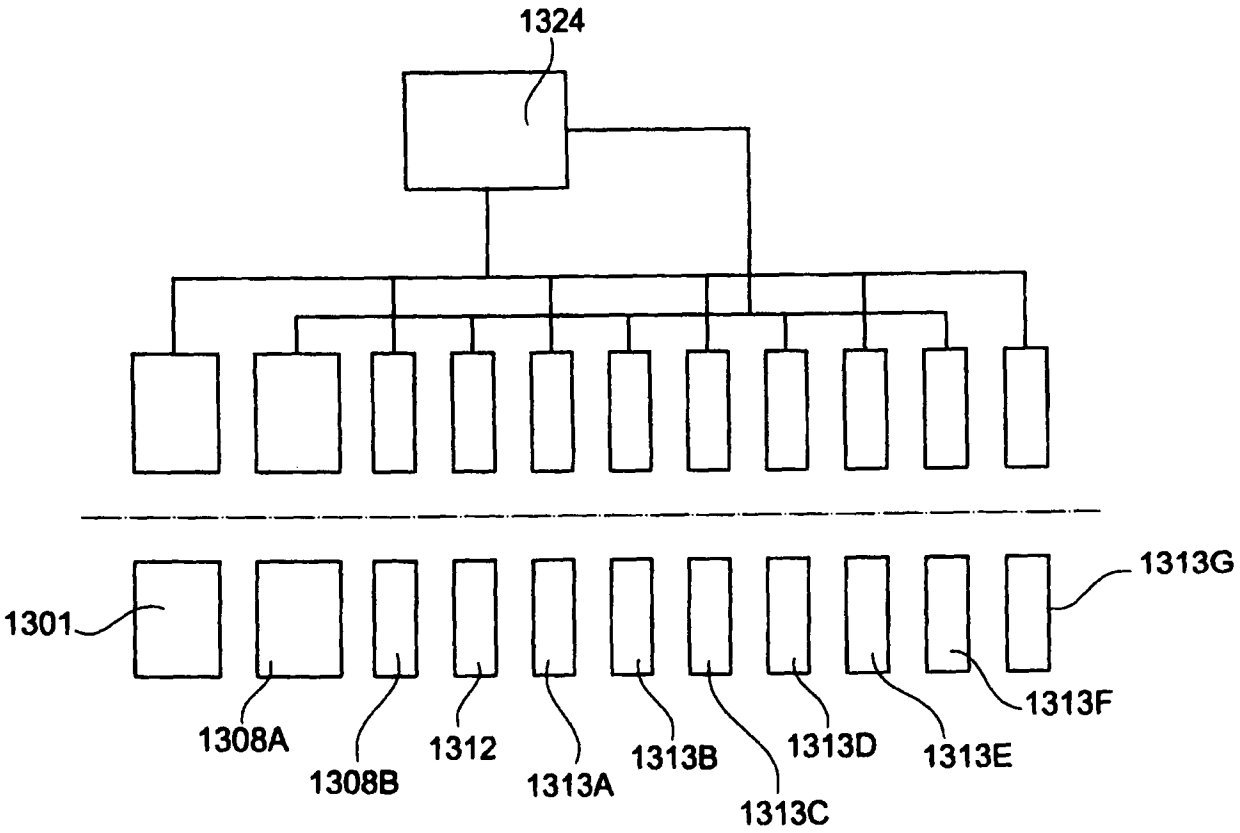
FIG. 13 shows a further schematic illustration of the ion transmission unit according to an embodiment of the system described herein.

In a further embodiment, units of the ion transmission unit 1300 are connected in parallel, as is shown schematically in FIG. 13. In this exemplary embodiment, the first quadrupole disk 1301, the second quadrupole device 1308B in the form of a disk, the third quadrupole device 1313A in the form of a disk, the fifth quadrupole device 1313C in the form of a disk, the seventh quadrupole device 1313E in the form of a disk and the ninth quadrupole device 1313G in the form of a disk are connected in parallel. Furthermore, the first quadrupole device 1308A in the form of a disk, the second quadrupole disk 1312, the fourth quadrupole device 1313B in the form of a disk, the sixth quadrupole device 1313D in the form of a disk and the eighth quadrupole device 1313F in the form of a disk are connected in parallel. It is explicitly noted that other parallel circuits, in particular of quadrupole devices that are quite a long distance away from one another, are provided in other embodiments.

Figure 14:
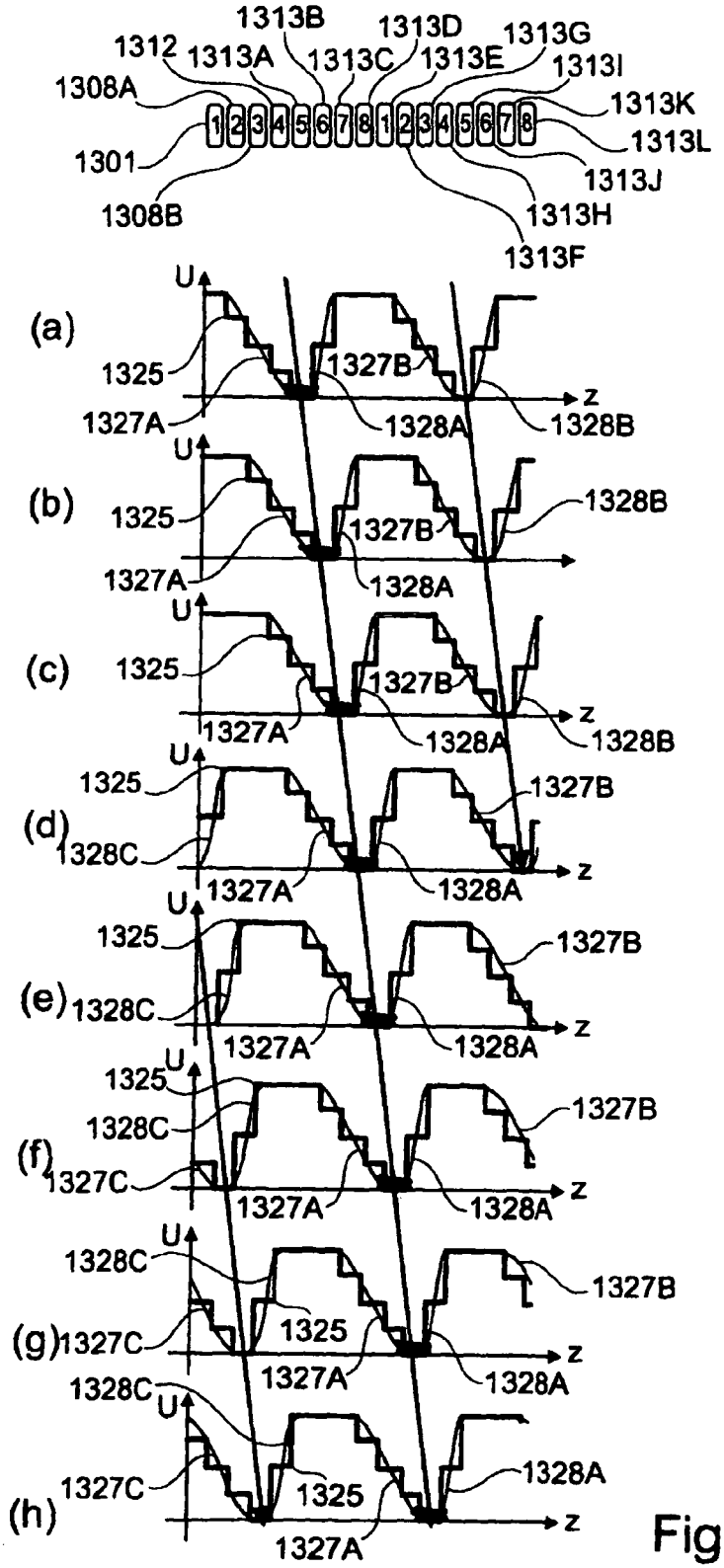
FIG. 14 shows a schematic illustration of a third exemplary embodiment of a potential profile in the ion transmission unit.

A further exemplary embodiment relating to parallel connection is shown in FIG. 14. FIG. 14 is based on FIG. 11, as a result of which reference is first of all made to all the above statements. FIGS. 14*a* to 14*h* show the time profile of the total potential, which is composed of the first to sixteenth potentials, in the ion transmission unit 1300, with FIG. 14*a* showing the earliest instantaneous record of the total potential in time, and FIG. 14*h* showing the latest instantaneous record of the total potential in time. The maximum total potential is once again in the region of a few volts here, for example 2 V to 3 V. In the exemplary embodiment illustrated in FIG. 14, the following units are connected in parallel: the first quadrupole disk 1301 and the seventh quadrupole device 1313E in the form of a disk, the first quadrupole device 1308A in the form of a disk and the eighth quadrupole device 1313F in the form of a disk, the second quadrupole device 1308B in the form of a disk and the ninth quadrupole device 1313G in the form of a disk, the second quadrupole disk 1312 and the tenth quadrupole device 1313H in the form of a disk, the third quadrupole device 1313A in the form of a disk and the eleventh quadrupole device 1313I in the form of a disk, the fourth quadrupole device 1313B in the form of a disk and the twelfth quadrupole device 1313J in the form of a disk, the fifth quadrupole device 1313C in the form of a disk and the thirteenth quadrupole device 1313K in the form of a disk, as well as the sixth quadrupole device 1313D in the form of a disk and the fourteenth quadrupole device 1313L in the form of a disk. First of all, a first potential well and a second potential well are illustrated in FIG. 14*a*. The first potential well has a first left-hand flank 1327A and a first right-hand flank 1328A. The second potential well has a second left-hand flank 1327B and a second right-hand flank 1328B. The first left-hand flank 1327A of the first potential well is designed such that the secondary ions which still have only thermal energy can fall into the first potential well from the area of the first quadrupole disk 1301. The first right-hand flank 1328A, which is provided in the area of the fourth quadrupole device 1313B in the form of a disk and the fifth quadrupole device 1313C in the form of a disk, is designed to be sufficiently steep that the secondary ions can no longer leave the first potential well on the first right-hand flank 1328A. The first left-hand flank 1327A is also designed such that the secondary ions can no longer leave the first potential well, with the gas pressure in this area still being sufficiently high that the secondary ions can transmit energy to neutral gas particles by impacts. This ensures that the secondary ions can no longer leave the potential well. The state in FIG. 14*a* is now maintained for a predetermined time (for example in the region of a few milliseconds). The secondary ions are collected in the first potential well (accumulation of the secondary ions) in this predetermined time (accumulation time). The first to sixteenth potentials are now switched such that, on the one hand, the first left-hand flank 1327A and the first right-hand flank 1328A, and on the other hand the second left-hand flank 1327B and the second right-hand flank 1328B, are moved along the second longitudinal axis 1307 (FIGS. 14*b* to 14*h*). Both the first potential well and the second potential well are therefore moved. The secondary ions are forced to move in the direction of the analysis unit 1400 by this movement of the first left-hand flank 1327A and of the first right-hand flank 1328A. In this way, the secondary ions are transported in the ion transmission unit 1300. The first left-hand flank 1327A and the first right-hand flank 1328A are moved until the secondary ions are located slightly in front of the analysis unit 1400. In the exemplary embodiment illustrated in FIG. 14, new potential wells are repeatedly generated. As can be seen from FIGS. 14*d* to 14*h*, a third potential well is created with a third left-hand flank 1327C and a third right-hand flank 1328C. Secondary ions can now once again fall into this third potential well. The third potential well is then moved along the second longitudinal axis 1307, to be precise in the same way as that described above. If FIG. 14 is considered, then this gives the impression that a wave of potential wells is moved in the direction of the analysis unit 1400 in the ion transmission unit 1300. In this case, the left-hand flank and the right-hand flank of each potential well are formed slowly.

The embodiments described above ensure that no significant kinetic energy is supplied to the secondary ions in this way of transport. They remain focused both axially and radially with respect to the second longitudinal axis 1307.

Because of unavoidable field errors in one of the quadrupole alternating fields which are generated in the ion transmission unit 1300, secondary ions can absorb kinetic energy in the area between two of the abovementioned quadrupole devices 1308A, 1308B and 1313A to 1313L, for example in the area between the first quadrupole device 1308A in the form of a disk and the second quadrupole device 1308B in the form of a disk. It is therefore worth considering designing this area, or even the entire ion transmission unit 1300, to be relatively short. However, this would decrease the effect of the further function of the ion transmission unit 1300, specifically the function as a pressure stage. It has now been shown that the solution described above (distributed pressure stage with transport of the secondary ions) represents a good compromise.

Figure 15:
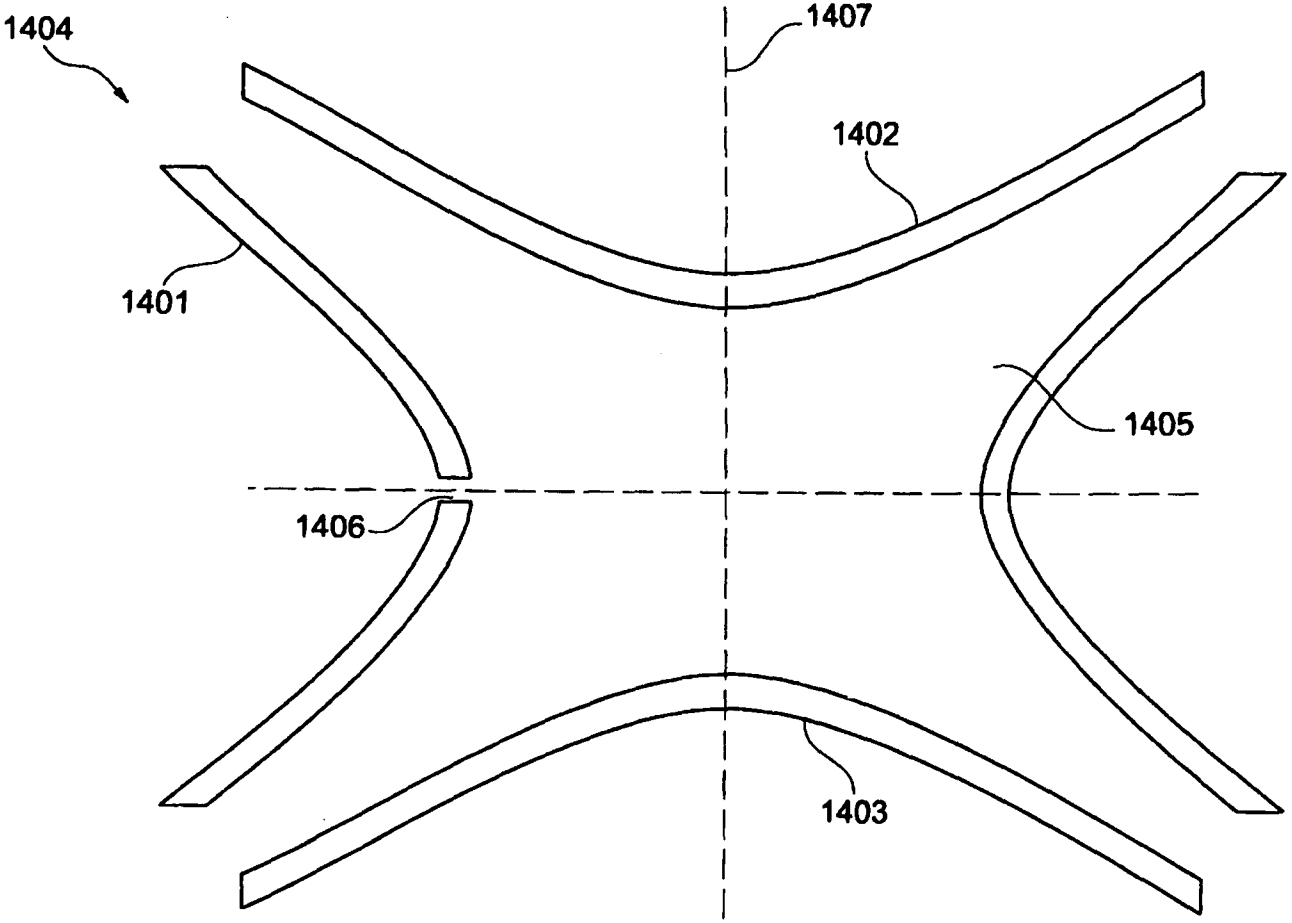
FIG. 15 shows a schematic illustration of a storage cell according to an embodiment of the system described herein.

The analysis unit 1400 (that is to say a detection unit) in the exemplary embodiment described here is in the form of a mass spectrometer, for example a time-of-flight mass spectrometer or ion-trap mass spectrometer. In particular, the analysis unit 1400 is designed such that it can be replaced, as already mentioned above. FIG. 15 shows a schematic section illustration of a storage cell 1404 of an ion-trap mass spectrometer. The storage cell 1404 is in the form of a Paul trap, and has an annular electrode 1401, a first end cap electrode 1402 and a second end cap electrode 1403. The annular electrode 1401 is arranged to be rotationally symmetrical around a first axis 1407. The first end cap electrode 1402 and the second end cap electrode 1403 are likewise arranged to be rotationally symmetrical around the first axis 1407. The annular electrode 1401 has an opening 1406 through which secondary ions can be injected into a second internal area 1405 in the storage cell 1404 from the ion transmission unit 1300. A storage field in the storage cell 1404 is switched off during the injection of the secondary ions. An electrical pulse is used to inject the secondary ions into the storage cell 1404, with these secondary ions having been transported by the ion transmission unit 1300 to the analysis unit 1400 and being located in one of the abovementioned potential wells immediately in front of the storage cell 1404. Because of the pulse, the secondary ions are supplied with kinetic energy, although this is the same for each secondary ion. This results in mass dispersion. Lightweight secondary ions travel back a greater distance than heavyweight secondary ions in the same time. This may lead to the problem that lightweight secondary ions arrive at the annular electrode 1401 before the heavyweight secondary ions have passed through the opening 1406 into the second internal area 1405 of the storage cell 1404. In order to reduce the effect of mass dispersion, a potential is applied via the first end cap electrode 1402 and the second end cap electrode 1403 such that a static quadrupole field is generated in the internal area 1405 of the storage cell 1404, such that secondary ions are braked in the center of the storage cell 1404. The abovementioned potential is therefore also referred to as a braking potential. The lightweight secondary ions are affected by the braking potential at a time before the heavyweight secondary ions, as a result of which the heavyweight secondary ions are able to "pull in" the lightweight secondary ions. As soon as the heavyweight secondary ions are in the second internal area 1405 of the storage cell 1404, the storage field is activated.

Because of the pulse, it is possible for the radial component of the kinetic energy of the secondary ions to be greater on entering the storage cell 1404 than the radial component of the kinetic energy of the secondary ions in the ion transmission unit 1300. The radial component of the kinetic energy of the secondary ions on entering the storage cell 1404 should be as low as possible (for example in the region of a few hundred meV), since this is otherwise converted to potential energy of the secondary ions in the storage cell 1404. In this case, the amplitude of the macro-oscillations of the secondary ions in the second internal area 1405 of the storage cell 1404 would be high, and the secondary ions would be lost for analysis.

Figure 16:
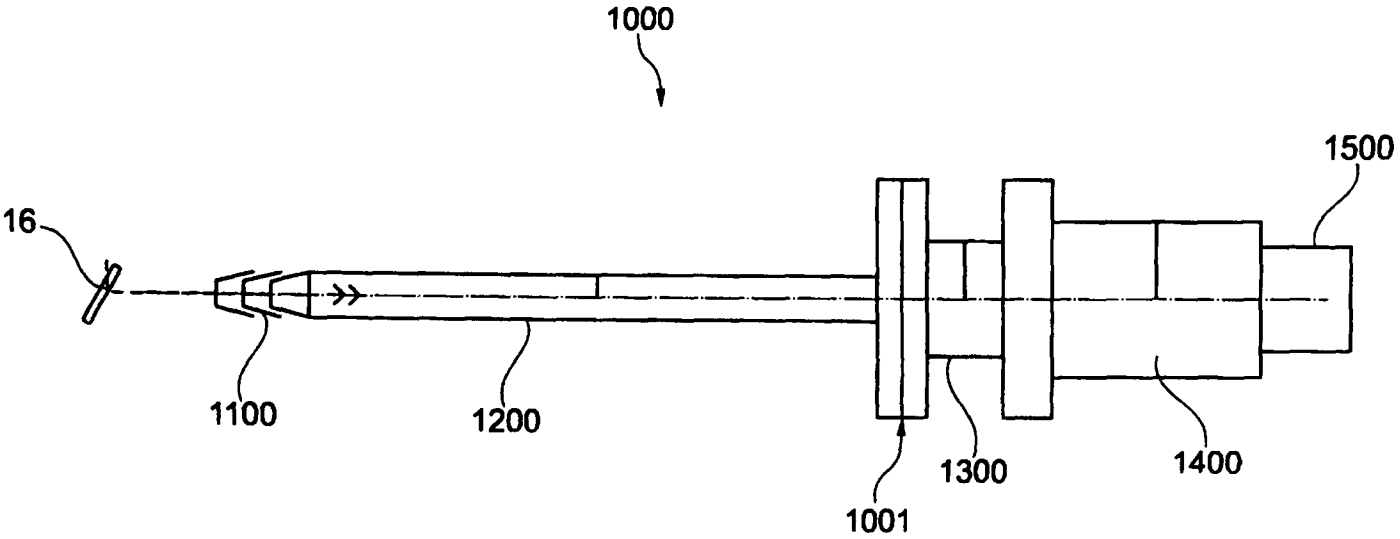
FIG. 16 shows a further schematic side view of a further particle analysis apparatus according to an embodiment of the system described herein.
Figure 17A:
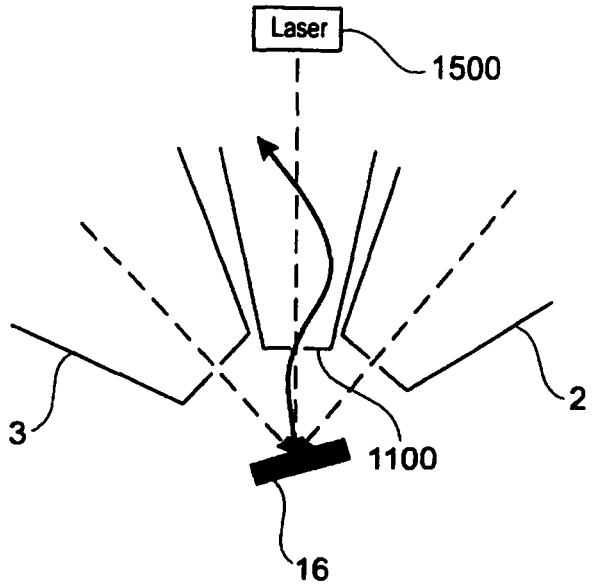
FIG. 17A shows a schematic illustration of an arrangement of the particle analysis apparatus as shown in FIG. 16 in the particle beam device.

FIG. 16 shows a further embodiment of the particle analysis apparatus 1000, in the form of a schematic side view, provided in the particle beam device 1 shown in FIG. 2. FIG. 16 is based on FIG. 3. The same components are provided with the same reference symbols. The particle analysis apparatus 1000 has the extraction unit 1100, the apparatus for energy transmission 1200, the ion transmission unit 1300 and the analysis unit 1400. The ion transmission unit 1300 and the analysis unit 1400 are arranged detachably on the sample chamber 49 via the connecting element 1001. A laser unit 1500 is additionally arranged on the analysis unit 1400 and makes it possible to pass a laser beam through the analysis unit 1400, through the ion transmission unit 1300, through the apparatus for energy transmission 1200 and through the extraction unit 1100 to the sample 16. FIG. 17A shows a schematic arrangement of the particle analysis apparatus 1000 in the particle beam device 1, in which case, in order to improve the clarity, FIG. 17A shows only the sample 16, the first particle beam column 2, the second particle beam column 3, the extraction unit 1100 and the laser unit 1500. Irradiation of the sample 16 by the laser beam makes it possible to generate further secondary ions on the sample 16, in addition to or as an alternative to generating secondary ions by the ion beam. The further secondary ions are then analyzed by the particle analysis apparatus 1000. This embodiment has the advantage that a relatively large area is illuminated by the laser beam, such that more secondary ions are produced in a predetermined time period by the sample 16 than is possible only by the ion beam. This leads to shorter accumulation times, that is to say the secondary ions are collected in the abovementioned potential well, thus allowing faster evaluation by mass analysis of the secondary ions. This embodiment is also advantageous for examination of dielectric samples. These are charged when bombarded with ions, as a result of which imaging by the second particle beam column 3 by electrons is difficult, if not impossible. For this reason, the laser beam of the laser unit 1500 may be used to generate secondary ions, instead of the ion beam.

Furthermore, in the embodiment illustrated in FIG. 17A, it is advantageous for the laser unit 1500 to be aligned with the particle analysis apparatus 1000 such that the laser beam is aligned parallel to the axis of the particle analysis apparatus 1000. This avoids an additional connection to the sample chamber for the laser unit 1500.

In yet another embodiment it is possible to use the laser beam of the laser unit 1500 for optical imaging at light frequencies. This results in a further examination method for the surface of the sample 16, in addition to imaging by electrons or ions.

In a further embodiment it is provided for the laser beam of the laser unit 1500 to be used for sample positioning and for finding a coincidence point of the ion beam and of the electron beam.

In yet another embodiment, the energy of the laser beam can be used in order to ionize neutral particles released from the sample 16. This increases the analysis efficiency by the particle analysis apparatus 1000.

Furthermore, certain areas of the sample 16 can be heated by the laser beam of the laser unit 1500. This makes it possible to carry out examinations on the sample 16 as a function of their temperature. Furthermore, this makes it possible to reduce the work function of the secondary ions, in order to achieve a higher "yield" of secondary ions.

In a further embodiment, spectroscopy can be carried out on secondary ions by laser light.

Furthermore, in the described exemplary embodiment, the sample 16 is irradiated alternately or successively by the ion beam and the laser beam from the laser unit 1500. For example, material can be removed coarsely from the sample 16 by the laser beam. This also results in secondary ions, which are analyzed. The coarse removal is continued until a specific element has been determined by the particle analysis apparatus 1000. Finer removal is then carried out, using the focused ion beam.

Figure 17B:
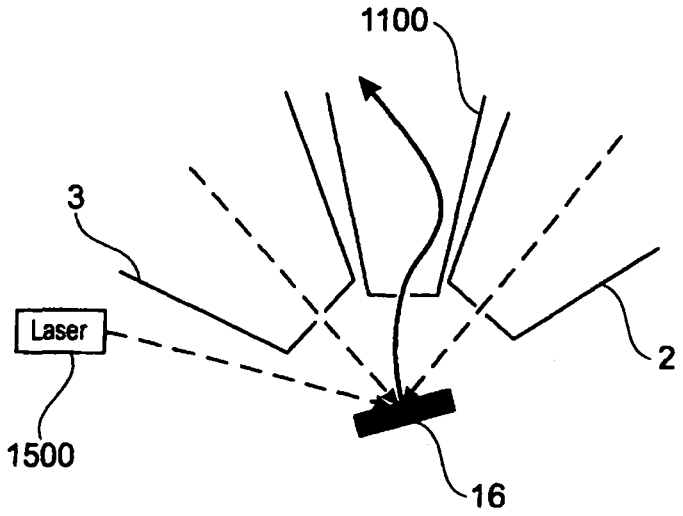
FIG. 17B shows a further schematic illustration of an arrangement of the particle analysis apparatus as shown in FIG. 16 in the particle beam device.

FIG. 17B is based on the exemplary embodiment shown in FIG. 17A. The same components are provided with the same reference symbols. Reference is therefore first of all made to all the comments made above, which also apply to the exemplary embodiment shown in FIG. 17B. In contrast to the exemplary embodiment shown in FIG. 17A, in the case of the exemplary embodiment shown in FIG. 17B, the laser unit 1500 is not arranged on the particle analysis apparatus 1000, but at the side, on the sample chamber 49.

Figure 17C:
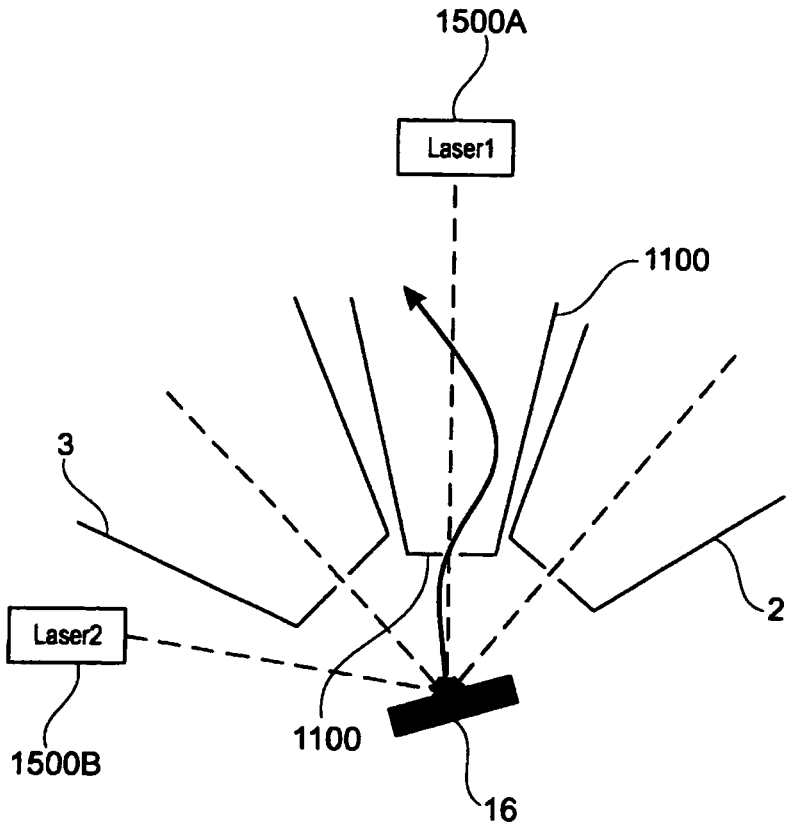
FIG. 17C shows yet another schematic illustration of an arrangement of the particle analysis apparatus as shown in FIG. 16 in the particle beam device.

FIG. 17C is likewise based on the exemplary embodiment shown in FIG. 17A. The same components are provided with the same reference symbols. Reference is therefore first of all made to all the comments made above, which also apply to the exemplary embodiment shown in FIG. 17C. In contrast to the exemplary embodiment shown in FIG. 17A, two laser units are provided in the exemplary embodiment shown in FIG. 17C. A first laser unit 1500A is arranged on the particle analysis apparatus 1000 (for example on the analysis unit 1400). Furthermore, a second laser unit 1500B is arranged on the sample chamber 49. Both the first laser unit 1500A and the second laser unit 1500B have at least one of the functions which have been explained further above.

It is explicitly also noted that the system described herein described above, in particular all of the embodiments of the system described herein mentioned above, is suitable both for positively charged ions and for negatively charged ions. The potentials described above will be chosen appropriately by a person skilled in the art, by inversion and adaptation of the potentials described above.

Various embodiments discussed herein may be combined with each other in appropriate combinations in connection with the system described herein. Additionally, in some instances, the order of steps in the flowcharts, flow diagrams and/or described flow processing may be modified, where appropriate. Further, various aspects of the system described herein may be implemented using software, hardware, a combination of software and hardware and/or other computer-implemented modules or devices having the described features and performing the described functions. Software implementations of the system described herein may include executable code that is stored in a computer readable storage medium and executed by one or more processors. The computer readable storage medium may include a computer hard drive, ROM, RAM, flash memory, portable computer storage media such as a CD-ROM, a DVD-ROM, a flash drive and/or other drive with, for example, a universal serial bus (USB) interface, and/or any other appropriate tangible storage medium or computer memory on which executable code may be stored and executed by a processor. The system described herein may be used in connection with any appropriate operating system.

Other embodiments of the invention will be apparent to those skilled in the art from a consideration of the specification or practice of the invention disclosed herein. It is intended that the specification and examples be considered as exemplary only, with the true scope and spirit of the invention being indicated by the following claims.

What is claimed is:

1. An apparatus for focusing and/or storage of ions, comprising:

at least one container for holding at least one ion, wherein the container has at least one outlet; and at least one multipole unit for providing a multipole alternating field, wherein the multipole unit is arranged at the outlet of the container, wherein the multipole unit has a through-opening with a longitudinal axis, wherein the multipole unit includes one printed circuit board, and wherein the multipole unit further includes:

at least one first electrode, at least one second electrode, at least one third electrode, at least one fourth electrode, at least one fifth electrode, at least one sixth electrode, at least one seventh electrode and at least one eighth electrode, wherein the first electrode, the second electrode, the third electrode and the fourth electrode are at the same radial distance from the longitudinal axis of the through-opening and are each at a first radial distance from the longitudinal axis of the through-opening, wherein the fifth electrode, the sixth electrode, the seventh electrode and the eighth electrode are at the same radial distance from the longitudinal axis of the through-opening, and are each at a second radial distance from the longitudinal axis of the through-opening, wherein the first radial distance is less than the second radial distance, and wherein the first electrode, the second electrode, the third electrode, the fourth electrode, the fifth electrode, the sixth electrode, the seventh electrode and the eighth electrode are all arranged on a single plane of the printed circuit board, at least the first electrode and the fifth electrode being arranged along a straight line that is perpendicular to the longitudinal axis, and wherein the printed circuit board is arranged perpendicular to the longitudinal axis.

2. The apparatus according to claim 1, wherein the multipole unit is in the form of a quadrupole unit for providing a quadrupole alternating field.

3. The apparatus according to claim 1, wherein the multipole unit has a first outer surface which is defined by the single plane of the printed circuit board.

4. The apparatus according to claim 3, wherein the multipole unit has a second outer surface which is arranged in the opposite direction to the first outer surface of the multipole unit, and wherein at least one of: the first electrode, the second electrode, the third electrode, the fourth electrode, the fifth electrode, the sixth electrode, the seventh electrode or the eighth electrode extends from the first outer surface to the second outer surface.

5. The apparatus according to claim 4, wherein the first outer surface and the second outer surface are separated such that a distance between the first outer surface and the second outer surface is in one of the following ranges:

from 0.5 mm to 50 mm,
from 0.5 mm to 40 mm,
from 0.5 mm to 30 mm,
from 0.5 mm to 20 mm,
from 0.5 mm to 10 mm, or
from 0.5 mm to 3 mm.

6. The apparatus according to claim 1, wherein the multipole unit is in the form of a disk.

7. The apparatus according to claim 1, wherein at least one of: the first electrode, the second electrode, the third electrode, the fourth electrode, the fifth electrode, the sixth electrode, the seventh electrode or the eighth electrode is hyperbolic.

8. The apparatus according to claim 1, wherein the through-opening has an extent in the radial direction with respect to the longitudinal axis, and wherein the extent is in at least one of the following ranges:

from 0.4 mm to 10 mm,
from 0.4 mm to 5 mm, or
from 0.4 mm to 1 mm.

9. A particle beam device, comprising:

a sample chamber;

a sample which is arranged in the sample chamber;

at least one first particle beam column, wherein the first particle beam column has a first beam generator for generating a first particle beam, and has a first objective lens for focusing the first particle beam onto the sample;

at least one generator that generates particles or radiation that strike the sample resulting in secondary ions which are emitted from the sample;

at least one collecting apparatus that collects the secondary ions;

at least one analysis unit that analyzes the secondary ions; and at least one focusing/storage apparatus for focusing and/or storage of ions, from a second pressure area, the at least one focusing/storage apparatus including:

at least one container for holding at least one ion, wherein the container has at least one outlet; and at least one multipole unit for providing a multipole alternating field, wherein the multipole unit is arranged at the outlet of the container, wherein the multipole unit has a through-opening with a longitudinal axis, wherein the multipole unit includes one printed circuit board, and wherein the multipole unit further includes:

at least one first electrode, at least one second electrode, at least one third electrode, at least one fourth electrode, at least one fifth electrode, at least one sixth electrode, at least one seventh electrode and at least one eighth electrode, wherein the first electrode, the second electrode, the third electrode and the fourth electrode are at the same radial distance from the longitudinal axis of the through-opening and are each at a first radial distance from the longitudinal axis of the through-opening, wherein the fifth electrode, the sixth electrode, the seventh electrode and the eighth electrode are at the same radial distance from the longitudinal axis of the through-opening, and are each at a second radial distance from the longitudinal axis of the through-opening, wherein the first radial distance is less than the second radial distance, and wherein the first electrode, the second electrode, the third electrode, the fourth electrode, the fifth electrode, the sixth electrode, the seventh electrode and the eighth electrode are all arranged on a single plane of the printed circuit board of the multipole unit, at least the first electrode and the fifth electrode being arranged along a straight line that is perpendicular to the longitudinal axis, and wherein the printed circuit board of the multipole unit is arranged perpendicular to the longitudinal axis.

10. The particle beam device according to claim 9, wherein the analysis unit is in the form of a mass spectrometer.

11. The particle beam device according to claim 9, wherein the analysis unit is arranged detachably on the separation apparatus by a connecting device.

12. The particle beam device according to claim 9, wherein the particle beam device has a laser unit.

13. The particle beam device according to claim 12, wherein the generator comprises the laser unit.

14. The particle beam device according to claim 9, wherein the generator is arranged on at least one of: the focusing/storage apparatus or the analysis unit.

15. The particle beam device according to claim 9, further comprising:

at least one second particle beam column, wherein the second particle beam column has a second beam generator for generating a second particle beam, and has a second objective lens for focusing the second particle beam onto the sample.

16. The particle beam device according to claim 15, further comprising one of the following features:

(i) the second particle beam column is in the form of an electron beam column, and the first particle beam column is in the form of an ion beam column, or (ii) the first particle beam column is in the form of an ion beam column, and the second particle beam column is in the form of an ion beam column.

17. An apparatus for focusing and/or storage of ions, comprising:

at least one container that holds at least one ion, the container having at least one outlet;

and at least one multipole unit, arranged at the outlet of the container, that provides a multipole alternating field, the multipole unit having a through-opening with a longitudinal axis and having a printed circuit board arranged perpendicular to the longitudinal axis and having a first group of at least four electrodes in a plane of the printed circuit board and a second group of at least four electrodes in the plane of the printed circuit board, the first group of electrodes being at a first radial distance from the longitudinal axis and the second group of electrodes being a second radial distance from the longitudinal axis, wherein at least one electrode of the first group and at least one electrode of the second group are arranged along a straight line that is perpendicular to the longitudinal axis.

* * * * *